US010542817B2

(12) United States Patent
Swartz et al.

(10) Patent No.: US 10,542,817 B2
(45) Date of Patent: Jan. 28, 2020

(54) HEIGHT ADJUSTABLE DEVICE

(71) Applicant: Ergotron, Inc., St. Paul, MN (US)

(72) Inventors: Nicholas Robert Swartz, Minneapolis, MN (US); Shaun Christopher Lindblad, Lino Lakes, MN (US); Jeffrey Randall Mensing, Blaine, MN (US)

(73) Assignee: Ergotron, Inc., St. Paul, MN (US)

( * ) Notice: Subject to any disclaimer, the term of this patent is extended or adjusted under 35 U.S.C. 154(b) by 0 days.

(21) Appl. No.: 15/762,427

(22) PCT Filed: Sep. 16, 2016

(86) PCT No.: PCT/US2016/052233

§ 371 (c)(1),
(2) Date: Mar. 22, 2018

(87) PCT Pub. No.: WO2017/053200

PCT Pub. Date: Mar. 30, 2017

(65) Prior Publication Data

US 2018/0255919 A1 Sep. 13, 2018

Related U.S. Application Data

(60) Provisional application No. 62/232,133, filed on Sep. 24, 2015.

(51) Int. Cl.
*A47B 9/16* (2006.01)
*A47B 9/02* (2006.01)
(Continued)

(52) U.S. Cl.
CPC ..... *A47B 9/16* (2013.01); *A47B 9/02* (2013.01); *A47B 9/12* (2013.01); *A47B 21/02* (2013.01)

(58) Field of Classification Search
CPC ..... A47B 21/0073; A47B 9/00; A47B 2200/0056; A47B 2200/0046; A47B 9/16;
(Continued)

(56) References Cited

U.S. PATENT DOCUMENTS 1,824,822 A 9/1931 Kradolfer
2,545,515 A 3/1951 Gannett et al.
(Continued)

FOREIGN PATENT DOCUMENTS

CN 202681006 U 1/2013
CN 106793868 A 5/2017
(Continued)

OTHER PUBLICATIONS

CN 107048694 Dai et al abstract and figure (Year: 2017).*
(Continued)

*Primary Examiner* — Janet M Wilkens
(74) *Attorney, Agent, or Firm* — Schwegman Lundberg & Woessner, P.A.

(57) ABSTRACT

A height adjustable device can comprise: a base; a first scissor linkage assembly coupled to the base and having a first scissor joint; a second scissor linkage assembly coupled to the base and having a second scissor joint; a worksurface coupled to the first and second scissor linkages; a bracket movably coupled to the first scissor linkage and the second scissor linkage and movable relative to the worksurface; and a first energy storage member coupled to the worksurface and connected by at least one tension member to the bracket, wherein the first energy storage member is configured to bias the bracket in a horizontal direction.

16 Claims, 18 Drawing Sheets

(51) Int. Cl.
*A47B 9/12* (2006.01)
*A47B 21/02* (2006.01)

(58) Field of Classification Search
CPC ..... A47B 5/006; A47B 5/04; A47B 21/02; A47B 21/0314; A47B 2021/0335; A47B 3/00; A47B 46/005; A47B 46/00; A47B 2023/049; A47B 2200/0063; B66F 7/0608; B66F 7/06; F16M 11/24; F16M 11/2014; F16M 11/2092; F16M 11/38; F16M 2200/004; F16M 2200/063; B60P 3/007; B60P 3/00
USPC ..... 312/208.1, 223.3, 306, 312, 196; 248/421, 562, 588, 585, 431, 432, 439, 248/280.11, 292.11, 919, 920, 923; 108/145, 144.11, 147, 93, 96, 116–118, 108/120, 43, 138, 33, 39, 14, 4, 9, 10, 108/50.02, 50.01, 146
See application file for complete search history.

(56) References Cited

U.S. PATENT DOCUMENTS 2,579,577 A 12/1951 Fayra
2,581,023 A 1/1952 Jerick
2,630,359 A 3/1953 Schade
2,727,799 A 12/1955 Keal
2,798,641 A * 7/1957 Coddington ..... B65G 1/07 108/117
3,203,373 A 8/1965 King et al.
3,245,366 A 4/1966 Fox
3,347,184 A 10/1967 Kiraly
3,727,245 A 4/1973 Gerth
3,888,451 A 6/1975 Lacey
4,032,103 A 6/1977 Ehrichs
4,073,240 A 2/1978 Fly
4,130,069 A 12/1978 Evans et al.
4,194,452 A 3/1980 Crowther et al.
4,515,086 A 5/1985 Kwiecinski et al.
4,534,544 A * 8/1985 Heide ..... B66F 7/0625 182/141
4,558,847 A 12/1985 Coates
4,577,821 A 3/1986 Edmo et al.
4,589,621 A 5/1986 Hunt et al.
4,625,657 A 12/1986 Little et al.
4,728,118 A 3/1988 Haas
4,981,052 A 1/1991 Gierer
4,981,085 A 1/1991 Gierer
5,039,054 A 8/1991 Pai
5,048,784 A 9/1991 Schwartz et al.
5,083,512 A 1/1992 Newhouse et al.
5,088,676 A 2/1992 Orchard et al.
5,174,223 A 12/1992 Nagy et al.
5,192,053 A 3/1993 Sehlstedt
5,251,864 A * 10/1993 Itou ..... B60N 2/502 248/588
5,322,025 A 6/1994 Sherman et al.
5,325,794 A 7/1994 Hontani
5,375,514 A 12/1994 Dann, Jr.
5,394,809 A 3/1995 Feldpausch et al.
5,490,466 A 2/1996 Diffrient
5,503,086 A 4/1996 Hoffman et al.
5,549,052 A 8/1996 Hoffman
5,553,550 A 9/1996 Doyle
5,588,377 A * 12/1996 Fahmian ..... A47B 9/00 108/145
5,649,493 A 7/1997 Blume
5,680,820 A 10/1997 Randolph
5,687,655 A 11/1997 Weinschenk, Jr. et al.
5,778,799 A 7/1998 Eyre
5,794,911 A * 8/1998 Hill ..... B60N 2/502 248/419
5,823,120 A 10/1998 Holmquist
5,833,198 A 11/1998 Graetz
5,938,340 A 8/1999 Brodersen
5,967,059 A 10/1999 Jensen
6,026,755 A 2/2000 Long
6,038,986 A 3/2000 Ransil et al.
6,283,047 B1 9/2001 Haller(-Hess)
6,286,441 B1 9/2001 Burdi
6,378,446 B1 4/2002 Long
6,439,657 B1 8/2002 Tholkes
6,510,803 B1 1/2003 Agee
6,516,478 B2 * 2/2003 Cook ..... A47C 19/045 108/147
6,520,091 B1 2/2003 Dettmers
6,603,157 B2 8/2003 Dupuy et al.
6,691,626 B2 2/2004 Warner
6,701,853 B1 3/2004 Hwang
6,874,431 B1 4/2005 Danna
6,991,199 B2 1/2006 Carpentier
7,048,236 B2 5/2006 Benden
7,059,254 B2 6/2006 Strong et al.
7,201,108 B2 4/2007 Eusebi et al.
7,246,784 B1 7/2007 Lopez
7,385,376 B2 6/2008 Zolfaghari
7,548,051 B1 6/2009 Tenbroek et al.
7,642,759 B2 1/2010 Dobkin
7,654,208 B2 2/2010 Patten et al.
7,677,518 B2 3/2010 Chouinard et al.
7,690,317 B2 4/2010 Beck et al.
7,849,789 B1 12/2010 Whelan
7,887,014 B2 2/2011 Lindblad et al.
7,950,338 B2 5/2011 Smed
8,065,966 B1 11/2011 Bacon et al.
8,132,518 B2 3/2012 Kim et al.
8,439,319 B2 5/2013 Page et al.
8,544,391 B2 10/2013 Knox et al.
8,671,853 B2 3/2014 Flaherty
8,783,639 B2 7/2014 Lindblad et al.
8,800,454 B2 8/2014 Jones
8,931,750 B2 * 1/2015 Kohl ..... B60N 2/502 248/588
8,950,343 B2 2/2015 Huang
9,049,923 B1 6/2015 Delagey
9,055,810 B2 6/2015 Flaherty
9,072,645 B2 7/2015 Gamman et al.
9,113,703 B2 8/2015 Flaherty
9,668,572 B2 6/2017 Ergun et al.
2002/0189505 A1 12/2002 Markofer
2003/0213415 A1 11/2003 Ross et al.
2004/0187742 A1 9/2004 Eusebi et al.
2004/0227443 A1 11/2004 Sandoval
2005/0041721 A1 2/2005 Jensen et al.
2005/0248239 A1 11/2005 Newhouse
2006/0037518 A1 2/2006 Lopez Alba
2006/0038383 A1 2/2006 Wu
2006/0157628 A1 7/2006 Mileos et al.
2007/0163475 A1 7/2007 Murphy
2007/0259554 A1 11/2007 Lindblad
2007/0266912 A1 11/2007 Swain
2007/0295882 A1 * 12/2007 Catton ..... B60N 2/502 248/588
2008/0308016 A1 12/2008 Meyer
2009/0179121 A1 7/2009 Lindblad et al.
2010/0242174 A1 9/2010 Morrison, Sr. et al.
2010/0257671 A1 10/2010 Shimada et al.
2011/0120351 A1 5/2011 Shoenfeld
2011/0168062 A1 7/2011 Dellavecchia
2011/0247532 A1 10/2011 Jones
2013/0014674 A1 1/2013 Burkhalter
2013/0139736 A1 6/2013 Flaherty
2013/0145972 A1 6/2013 Knox et al.
2013/0199420 A1 8/2013 Hjelm
2013/0340655 A1 12/2013 Flaherty
2014/0020606 A1 1/2014 Benden
2014/0041554 A1 * 2/2014 Huang ..... A47B 9/16 108/50.11
2014/0144352 A1 5/2014 Roberts
2014/0158026 A1 6/2014 Flaherty
2014/0165882 A1 6/2014 Plikat et al.
2014/0360411 A1 12/2014 Hatter

(56) References Cited

U.S. PATENT DOCUMENTS

| | | | | |
|---|---|---|---|---|
| 2015/0164218 | A1 | 6/2015 | Bonuccelli | |
| 2015/0216296 | A1 | 8/2015 | Mitchell | |
| 2015/0231992 | A1 | 8/2015 | Gundall et al. | |
| 2015/0250303 | A1 | 9/2015 | Flaherty | |
| 2015/0289641 | A1 | 10/2015 | Ergun et al. | |
| 2016/0120300 | A1 | 5/2016 | Ergun et al. | |
| 2016/0198853 | A1 | 7/2016 | Liu | |
| 2016/0278515 | A1 | 9/2016 | Ergun et al. | |
| 2016/0338486 | A1* | 11/2016 | Martin | A47B 9/16 |
| 2017/0354245 | A1* | 12/2017 | Martin | A47B 21/02 |
| 2017/0360188 | A1 | 12/2017 | Alguire | |
| 2018/0103752 | A1 | 4/2018 | Zhong | |
| 2018/0146775 | A1* | 5/2018 | You | A47B 9/16 |
| 2018/0160799 | A1* | 6/2018 | Westerg Rd | A47B 9/16 |
| 2018/0213929 | A1 | 8/2018 | Ergun et al. | |
| 2018/0279772 | A1 | 10/2018 | Ergun Et et al. | |

FOREIGN PATENT DOCUMENTS

| | | | |
|---|---|---|---|
| CN | 108024625 | | 5/2018 |
| DE | 7114367 | U | 6/1972 |
| DE | 4336833 | A1 | 6/1994 |
| DE | 4424564 | A1 | 1/1996 |
| DE | 19517825 | A1 | 11/1996 |
| DE | 102012110389 | A1 | 4/2014 |
| DE | 202016102015 | * | 6/2016 |
| EP | 0142919 | A1 | 5/1985 |
| EP | 0229585 | A1 | 7/1987 |
| EP | 0706769 | A2 | 4/1996 |
| EP | 2745733 | A1 | 6/2014 |
| EP | 2 842 458 | A1 | 3/2015 |
| FR | 1093171 | A | 5/1955 |
| GB | 2341790 | A | 3/2000 |
| JP | S5861051 | U | 4/1983 |
| JP | 5950172 | B1 | 7/2016 |
| JP | 2017511246 | A | 4/2017 |
| KR | 101527121 | B1 | 6/2015 |
| WO | WO-90000868 | A1 | 2/1990 |
| WO | WO-9515097 | A1 | 6/1995 |
| WO | WO-9952398 | A1 | 10/1999 |
| WO | WO-2004/047645 | | 6/2004 |
| WO | WO-2004047645 | A1 | 6/2004 |
| WO | WO-2005041721 | A2 | 5/2005 |
| WO | WO-2015160825 | A2 | 10/2015 |
| WO | WO-2015160825 | A3 | 10/2015 |
| WO | WO-2016129971 | | 8/2016 |
| WO | 2016200318 | * | 12/2016 |
| WO | WO-2016209513 | A1 | 12/2016 |
| WO | WO-2017053200 | A1 | 3/2017 |
| WO | WO-2017062589 | A1 | 4/2017 |

OTHER PUBLICATIONS

"Application Serial No. PCT US2016 052233, International Preliminary Report on Patentability dated", 12 pgs.
"Application file No. PCT US2016 055704 International Preliminary Report on Patentability dated Apr. 19, 2018", 9 pgs.
"European Application Serial No. 16777839.8, Response filed Oct. 9, 2018 to Communication Pursuant to Rules 161 and 162 EPC dated May 7, 2018", 20 pgs.
"European Application Serial No. 16784658.3, Response filed Dec. 17, 2018 to Communication Pursuant to Rules 161 and 162 dated Jun. 7, 2018", 21 pgs.
"U.S. Appl. No. 15/763,803, Non Final Office Action dated Dec. 5, 2018", 11 pgs.
"U.S. Appl. No. 14/686,465, Non Final Office Action dated Mar. 9, 2016", 12 pgs.
"U.S. Appl. No. 14/686,465, Non Final Office Action dated Jul. 29, 2016", 11 pgs.
"U.S. Appl. No. 14/686,465, Non Final Office Action dated Nov. 12, 2015", 11 pgs.
"U.S. Appl. No. 14/686,465, Response filed Feb. 8, 2016 to Non Final Office Action dated Nov. 12, 2015", 12 pgs.
"U.S. Appl. No. 14/686,465, Response filed Jul. 11, 2016 to Non Final Office Action dated Mar. 9, 2016", 11 pgs.
"U.S. Appl. No. 14/686,465, Response filed Oct. 28, 2015 to Restriction Requirement dated Aug. 28, 2015", 8 pgs.
"U.S. Appl. No. 14/686,465, Restriction Requirement dated Aug. 28, 2015", 6 pgs.
"U.S. Appl. No. 14/971,227, Advisory Action dated Jan. 23, 2017", 4 pgs.
"U.S. Appl. No. 14/971,227, Final Office Action dated Nov. 2, 2016", 9 pgs.
"U.S. Appl. No. 14/971,227, Final Office Action dated Nov. 8, 2017", 13 pgs.
"U.S. Appl. No. 14/971,227, Non Final Office Action dated Mar. 17, 2017", 14 pgs.
"U.S. Appl. No. 14/971,227, Non Final Office Action dated Jul. 11, 2016", 13 pgs.
"U.S. Appl. No. 14/971,227, Response filed Feb. 27, 2017 to Advisory Action dated Jan. 23, 2017", 20 pgs.
"U.S. Appl. No. 14/971,227, Response filed Apr. 6, 2016 to Restriction Requirement dated Feb. 11, 2016", 6 pgs.
"U.S. Appl. No. 14/971,227, Response filed Jul. 17, 2017 to Non Final Office Action dated Mar. 17, 2017", 21 pgs.
"U.S. Appl. No. 14/971,227, Response filed Sep. 29, 2016 to Non Final Office Action dated Jul. 11, 2016", 11 pgs.
"U.S. Appl. No. 14/971,227, Response filed Dec. 28, 2016 to Final Office Action dated Nov. 2, 2016", 15 pgs.
"U.S. Appl. No. 14/971,227, Restriction Requirement dated Feb. 11, 2016", 6 pgs.
"U.S. Appl. No. 15/178,794, Examiner Interview Summary dated Dec. 12, 2016", 3 pgs.
"U.S. Appl. No. 15/178,794, Non Final Office Action dated Nov. 15, 2016", 16 pgs.
"U.S. Appl. No. 15/178,794, Notice of Allowance dated Feb. 8, 2017", 7 pgs.
"U.S. Appl. No. 15/178,794, Response filed Aug. 25, 2016 to Restriction Requirement dated Jul. 14, 2016", 7 pgs.
"U.S. Appl. No. 15/178,794, Response filed Dec. 28, 2016 to Non Final Office Action dated Nov. 15, 2016", 19 pgs.
"U.S. Appl. No. 15/178,794, Restriction Requirement dated Jul. 14, 2016", 5 pgs.
"U.S. Appl. No. 15/892,167, Preliminary Amendment filed Feb. 21, 2018", 8 pgs.
"Australian Application Serial No. 2015247798, First Examiners Report dated Oct. 31, 2017", 6 pgs.
"Australian Application Serial No. 2015247798, Response filed Jan. 24, 2018 to First Examiners Report dated Oct. 31, 2017", 50 pgs.
"Chinese Application Serial No. 201580024630.5, Voluntary Amendment filed Aug. 25, 2017", w/ claims in English, 13 pgs.
"Computer Taskmate tm HealthPostures Feel Better in motion", [Online]. Retrieved from the Internet: <URL: www.healthpostures.com, 3 pgs.
"Computer Taskmate tm Product Information", [Online]. Retrieved from the Internet: <URL: www.varidesk.com, 2 pgs.
"European Application No. 15780177.0, Office Action dated Nov. 22, 2016", 2 pg.
"European Application Serial No. 15780177.0, Extended European Search Report dated Feb. 2, 2018", 12 pgs.
"European Application Serial No. 15780177.0, Invitation pursuant to Rule 63(1) EPC dated Oct. 6, 2017", 3 pgs.
"International Application U.S. Appl. No. PCT/US2015/025780, International Preliminary Report on Patentability dated Oct. 27, 2016", 7 pgs.
"International Application Serial No. PCT/US2015/025780, International Search Report dated Dec. 7, 2015", 2 pgs.
"International Application Serial No. PCT/US2015/025780, Written Opinion dated Dec. 7, 2015", 5 pgs.
"International Application Serial No. PCT/US2016/034156, International Preliminary Report on Patentability dated Jan. 4, 2018", 9 pgs.
"International Application Serial No. PCT/US2016/034156, International Search Report dated Aug. 5, 2016".
"International Application Serial No. PCT/US2016/034156, Written Opinion dated Aug. 5, 2016".

(56) References Cited

OTHER PUBLICATIONS

"International Application Serial No. PCT/US2016/052233, International Search Report dated Dec. 1, 2017", 6 pgs.
"International Application Serial No. PCT/US2016/052233, Invitation to Pay Add'l Fees and Partial Search Report dated Nov. 18, 2016", 6 pgs.
"International Application Serial No. PCT/US2016/052233, Written Opinion dated Dec. 1, 2017", 10 pgs.
"International Application Serial No. PCT/US2016/055704, International Search Report dated Dec. 20, 2016", 5 pgs.
"International Application Serial No. PCT/US2016/055704, Written Opinion dated Dec. 20, 2016", 7 pgs.
"Office Theme", [Online]. Retrieved from the Internet: <URL: Varidesk.com, 6 pgs.
"Sales Order Form re: Taskmate", Products shipped from HealthPostures, LLC. to ARC Ergonomics, (Sep. 30, 2008), 2 pgs.
"U.S. Appl. No. 15/763,803, Response filed Mar. 4, 2019 to Non Final Office Action dated Dec. 5, 2018", 11 pgs.
"Canadian Application Serial No. 2,999,757, Office Action dated Jan. 18, 2019", 4 pgs.
"U.S. Appl. No. 15/892,167, Non Final Office Action dated Feb. 19, 2019", 12 pgs.
"U.S. Appl. No. 15/763,803, Final Office Action dated May 10, 2019", 12 pgs.
"U.S. Appl. No. 15/892,167, Response filed Jun. 19, 2019 to Non-Final Office Action dated Feb. 19, 2019", 9 pgs.
"European Application Serial No. 16777839.8, Communication Pursuant to Article 94(3) EPC dated Jun. 5, 2019", 4 pgs.
"European Application Serial No. 16777839.8, Communication Under Rule 164(2)(a) EPC dated Feb. 20, 2019", 4 pgs.
"U.S. Appl. No. 15/763,803, Advisory Action dated Aug. 23, 2019", 3 pgs.
"U.S. Appl. No. 15/763,803, Response filed Sep. 10, 2019 to Advisory Action dated Aug. 23, 2019", 7 pgs.
"U.S. Appl. No. 15/763,803, Notice of Allowance dated Oct. 1, 2019", 6 pgs.
"U.S. Appl. No. 15/763,803, Notice of Allowance dated Oct. 30, 2019", 6 pgs.
"U.S. Appl. No. 15/892,167, PTO Response to Rule 312 Communication dated Nov. 18, 2019", 2 pgs.
"Canadian Application Serial No. 2,999,757, Response filed Jul. 17, 2019 to Office Action dated Jan. 18, 2019", 16 pgs.
"U.S. Appl. No. 15/892,167, Notice of Allowance dated Jul. 31, 2019", 5 pgs.
"U.S. Appl. No. 15/763,803, Response filed Aug. 12, 2019 to Final Office Action dated May 10, 2019", 15 pgs.

* cited by examiner

HEIGHT ADJUSTABLE DEVICE

CLAIM OF PRIORITY

This patent application is a U.S. National Stage Filing under 35 U.S.C. § 371 of International Patent Application No. PCT/US2016/052233, titled "HEIGHT ADJUSTABLE DEVICE." to Swartz et al., filed on Sep. 16, 2016, and published on Mar. 30, 2017, as WO 2017/053200 A1, which claims the benefit of priority of U.S. Provisional Patent Application Ser. No. 62/232,133, titled "HEIGHT ADJUSTABLE DEVICE," to Swartz et al., filed on Sep. 24, 2015, which are incorporated by reference herein in their entirety.

TECHNICAL FIELD

This disclosure generally relates to systems and methods for height adjustable devices.

BACKGROUND

Height adjustable devices can be used in desks, tables, desktop units, sit-to-stand applications or other applications. Existing height adjustable worksurfaces do not use a level force counter-balance system.

OVERVIEW

The present inventors have recognized, among other things, that a height adjustable device can be configured in an economical manner and have a constant lifting force throughout its vertical height adjustment range. This disclosure provides unique systems and methods for height adjustable devices. The present application discloses a height adjustable device that can include an energy storage member such as a locking gas spring which can act upon horizontal force between a moving bracket and a work surface. In the height adjustable device, a vertical lifting force can decrease as the scissor leg arms move closer to a horizontal or lowered position. To counteract such a decreasing force, a second energy storage device, such as a spring (torsion or equivalent) can be added to the scissor legs, such as at a link or joint between the scissor leg arms, and can increase in force as the scissor leg arms rotate relative to one another. By providing the two energy storage devices, one configured to act upon an angular force at a rotating scissor joint and one configured to act upon a horizontal force at a moving bracket, a constant vertical lifting force can be achieved. The height adjustable device can hold a weight placed on it throughout the whole vertical travel range.

For the purposes of this disclosure, the term "desk" can include any sort of desk, table, worksurface, or display surface. "Worksurface" can include any generally horizontal surface, but is not limited to surfaces used for "work". In addition, the height adjustable device can be configured to support any item that can benefit by an adjustable height and in such cases, the item can be substituted for the "worksurface". A height adjustable device can be configured as a desktop unit that can sit atop a table or desk and can be used to hold a computer, a computer system, a computer monitor, a laptop or notebook computer, a worksurface, tools, instruments or other items. A height adjustable device can be configured as a stand-alone table, desk or worksurface and can allow an operator to use the height adjustable device in a standing or sitting position.

This overview is intended to provide an overview of subject matter of the present patent application. It is not intended to provide an exclusive or exhaustive explanation of the invention. The detailed description is included to provide further information about the present patent application. The details of one or more aspects of the disclosure are set forth in the accompanying drawings and the description below. Other features, objects, and advantages will be apparent from the description and drawings, and from the claims.

To further illustrate the HEIGHT ADJUSTABLE DEVICE disclosed herein, a non-limiting list of examples is provided here:

In Example 1, a height adjustable device can comprise: a base; a first scissor linkage assembly coupled to the base and having a first scissor joint; a second scissor linkage assembly coupled to the base and having a second scissor joint; a worksurface coupled to the first and second scissor linkages; a bracket movably coupled to the first scissor linkage and the second scissor linkage and movable relative to the worksurface; and a first energy storage member coupled to the worksurface and connected by at least one tension member to the bracket, wherein the first energy storage member is configured to bias the bracket in a horizontal direction.

In Example 2, the height adjustable device of Example 1 can optionally be configured to further comprise: a second energy storage member located at one of the first and second scissor joints, the second energy storage member configured to bias the worksurface upwardly; and wherein the first energy storage member and the second energy storage member are configured to provide the height adjustable device with a constant lifting force throughout a vertical height adjustment range.

In Example 3, the height adjustable device of any one or any combination of Examples 1-2 can optionally be configured to further comprise: a second energy storage member located at one of the first and second scissor joints, the second energy storage member configured to bias the worksurface upwardly.

In Example 4, the height adjustable device of Example 3 can optionally be configured such that the first energy storage member and the second energy storage member are configured to provide the height adjustable device with a constant lifting force throughout a vertical height adjustment range.

In Example 5, the height adjustable device of any one or any combination of Examples 1-4 can optionally be configured such that the first energy storage member is a gas spring.

In Example 6, the height adjustable device of Example 5 can optionally be configured to further comprise: a cradle member coupled to the worksurface and slidably coupled to the gas spring.

In Example 7, the height adjustable device of Example 5 can optionally be configured such that the gas spring includes a movable piston configured to extend through an aperture in the bracket.

In Example 8, the height adjustable device of Example 5 can optionally be configured to further comprise: a pulley assembly coupled to the gas spring.

In Example 9, the height adjustable device of Example 8 can optionally be configured such that the pulley assembly includes a first pulley wheel rotably engaging a first tension member, the first tension member connecting the bracket and the cradle member.

In Example 10, the height adjustable device of Example 9 can optionally be configured such that the pulley assembly includes a second pulley wheel rotably engaging a second tension member, the second tension member connecting the bracket and the cradle member.

In Example 11, the height adjustable device of any one or any combination of Examples 2-10 can optionally be configured such that the second energy storage member is a torsion spring.

In Example 12, the height adjustable device of any one or any combination of Examples 1-11 can optionally be configured such that the first scissor linkage assembly includes: a first arm member movably coupled to the base; and a second arm member coupled to the first arm member at the first scissor joint, the second arm member rotably coupled to the base; and wherein the second scissor linkage assembly includes: a third arm member movably coupled to the base; and a fourth arm member coupled to the third arm member at a second scissor joint, the fourth arm member rotably coupled to the base.

In Example 13, the height adjustable device of any one or any combination of Examples 1-12 can optionally be configured such that the base is configured in a U-shape.

In Example 14, the height adjustable device of any one or any combination of Examples 1-13 can optionally be configured to further comprise: an extension spring coupled to the bracket and to the worksurface and configured to bias the bracket in a horizontal direction.

In Example 15, the height adjustable device of any one or any combination of Examples 1-14 can optionally be configured to further comprise: an enclosure bracket attached to a bottom surface of the worksurface, wherein first and second scissor linkage assemblies are rotably attached to the enclosure bracket.

In Example 16, the height adjustable device of any one or any combination of Examples 1-15 can optionally be configured such that the first scissor linkage assembly includes a first roller configured to roll on the base and the first scissor linkage assembly includes a second roller configured to roll on the base.

In Example 17, the height adjustable device of any one or any combination of Examples 1-16 can optionally be configured such that the first energy storage member is a gas spring coupled to the worksurface, extending through an aperture in the bracket, and connected by at least one tension member to the bracket, wherein the gas spring is configured to bias the bracket in a horizontal direction; wherein the second energy storage member is a torsion spring located at one of the first and second scissor joints, the torsion spring configured to bias the worksurface upwardly; and wherein the gas spring and the torsion spring are configured to provide the height adjustable device with a constant lifting force throughout a vertical height adjustment range.

In Example 18, a height adjustable device can comprise: a base; a scissor linkage assembly including: a first gas spring assembly extending from a first end to a second end, the first end rotably coupled to the base; and a second gas spring assembly extending from a third end to a fourth end, the third end rotably coupled to the base, a collar assembly having a first collar portion slidably coupled to the first gas spring assembly and a second collar portion slidably coupled to the second gas spring assembly, the first collar portion rotatingly coupled to the second collar portion by a scissor joint; and a worksurface coupled to the scissor linkage at the second end and the fourth end; wherein the scissor linkage is configured to bias the worksurface in the vertical direction.

In Example 19, the height adjustable device of Example 18 can optionally be configured to further comprise: a torsion spring coupled between the first collar portion and the second collar portion and configured to bias the worksurface in the vertical direction.

In Example 20, the height adjustable device of any one or any combination of Examples 18-19 can optionally be configured to further comprise: a first gas spring release handle configured to unlock the first gas spring assembly and a second gas spring release handle configured to unlock the second gas spring assembly.

In Example 21, the height adjustable device of any one or any combination of Examples 1-20 can optionally be configured such that all elements, operations, or other options recited are available to use or select from.

BRIEF DESCRIPTION OF THE DRAWINGS

Corresponding reference characters or text descriptions indicate corresponding parts throughout the several views. The exemplifications set out herein illustrate exemplary examples of this disclosure, and such exemplifications are not to be construed as limiting the scope of this disclosure in any manner.

DETAILED DESCRIPTION

Figure 1:
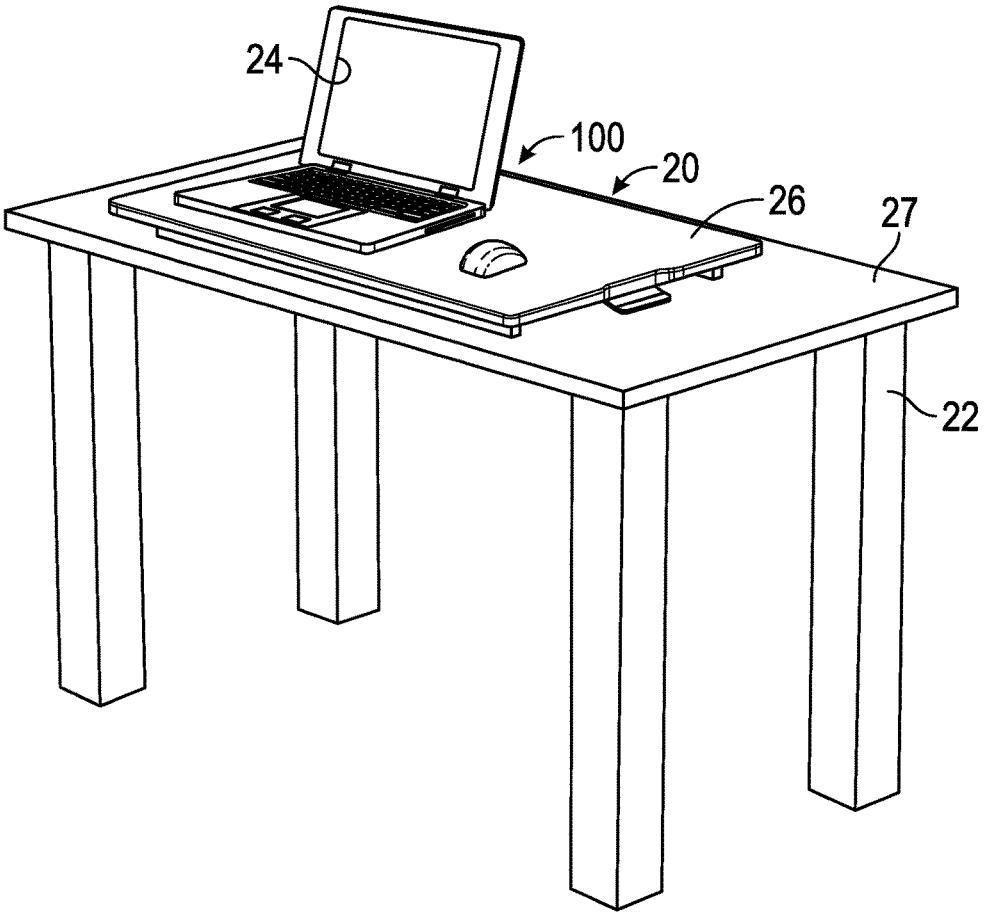
FIG. 1 illustrates a perspective view of a height adjustable device in a lowered position, in accordance with at least one example of this disclosure.

FIG. 1 illustrates a perspective view of a height adjustable device 100 in a lowered position 20, in accordance with at least one example of this disclosure. The height adjustable device 100 can be configured as a desktop platform that can provide for sitting or standing operations. The height adjustable device 100 can be located on a desk 22 and can support items such as an electronic device 24 on a worksurface 26. The desk 22 can be a table, a desk, a shelf, or other type of furniture. The desk 22 can include a desk top 27. The desk top 27 can be a table top, a desk top, a work surface, or other type of platform. The height adjustable device 100 can be configured as a desktop platform and can be free standing or permanently attached to the desk top 27.

Figure 2:
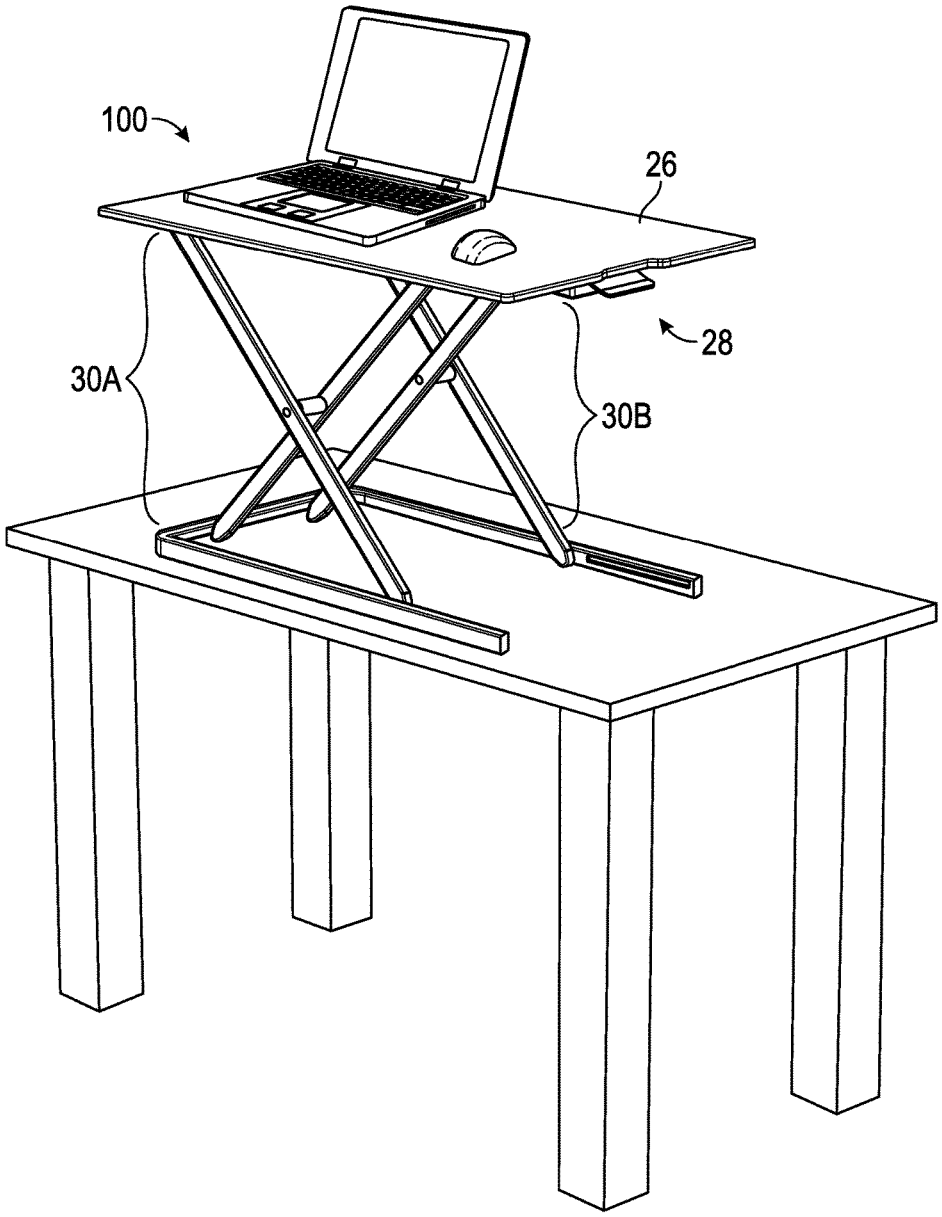
FIG. 2 illustrates a perspective view of a height adjustable device in a raised position, in accordance with at least one example of this disclosure.

FIG. 2 illustrates a perspective view of a height adjustable device 100 in a raised position 28, in accordance with at least one example of this disclosure. The raised position 28 can allow working at a standing position. The worksurface 26 can be supported by a first scissor linkage assembly 30A and a second scissor linkage assembly 30B. The first scissor linkage assembly 30A and the second scissor linkage assembly 30B can provide a scissoring action to aid in raising and lowering the height adjustable device 100.

Figure 3:
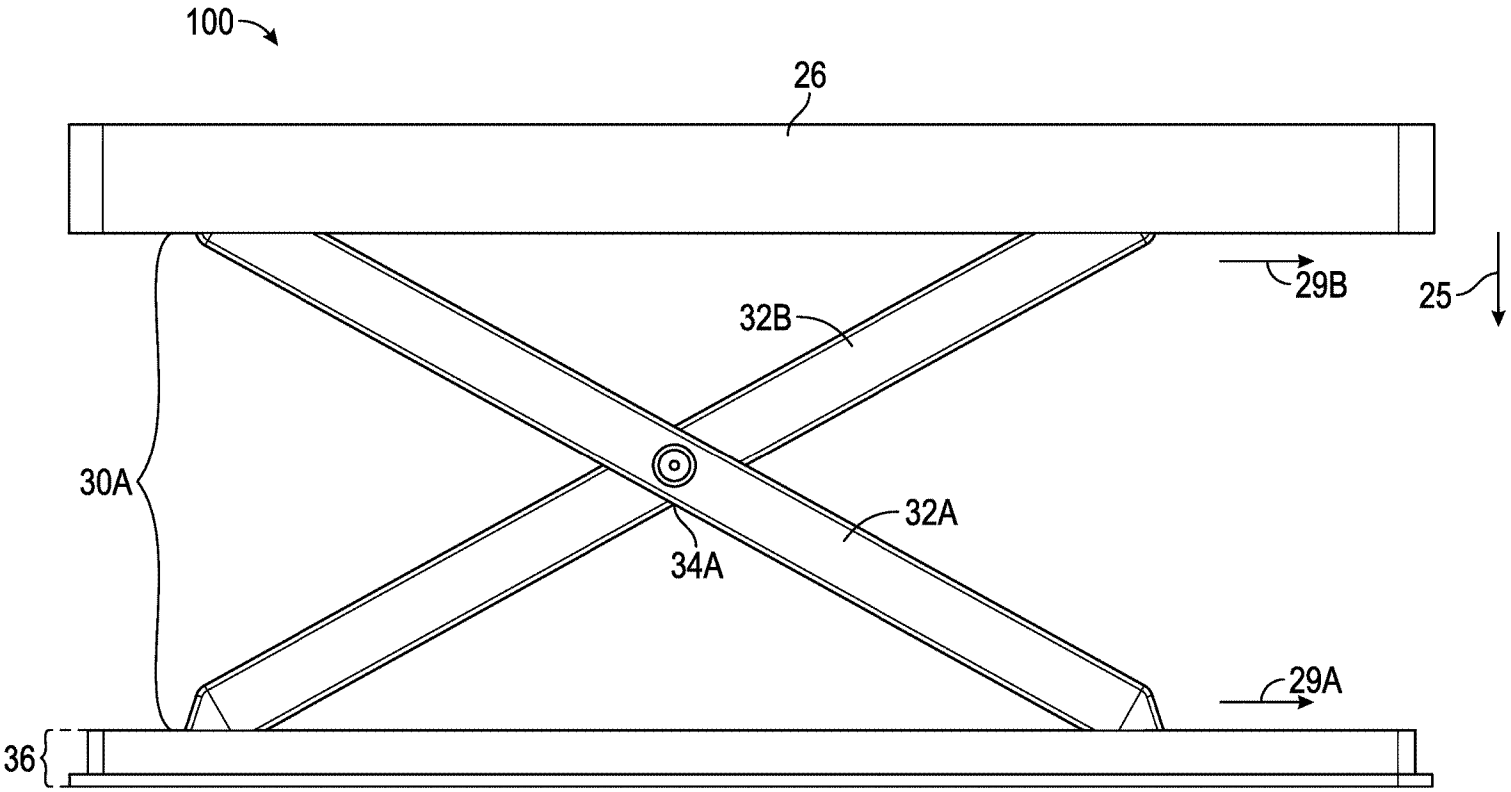
FIG. 3 illustrates a side view of a height adjustable device, in accordance with at least one example of this disclosure.

FIG. 3 illustrates a side view of a height adjustable device 100, in accordance with at least one example of this disclosure. The first scissor linkage assembly 30A can include a first arm member 32A that can be rotatingly coupled to a second arm member 32B at a first scissor joint 34A. The first scissor linkage assembly 30A and the second scissor linkage assembly 30B can be coupled to a base 36 (see also FIG. 4). When the worksurface 26 is moved downwardly 25, e.g. moved closer to the base 36, the lower end of the first arm member 32A can move horizontally closer 29A to the right side of the base 36. When the worksurface 26 is lowered, the upper end of the second arm member 32B can move horizontally closer 29B to the right side of the worksurface 26. The ends of the first arm member 32A and the second arm member 32B can move in the opposite direction when the worksurface 26 is raised.

Figure 4:
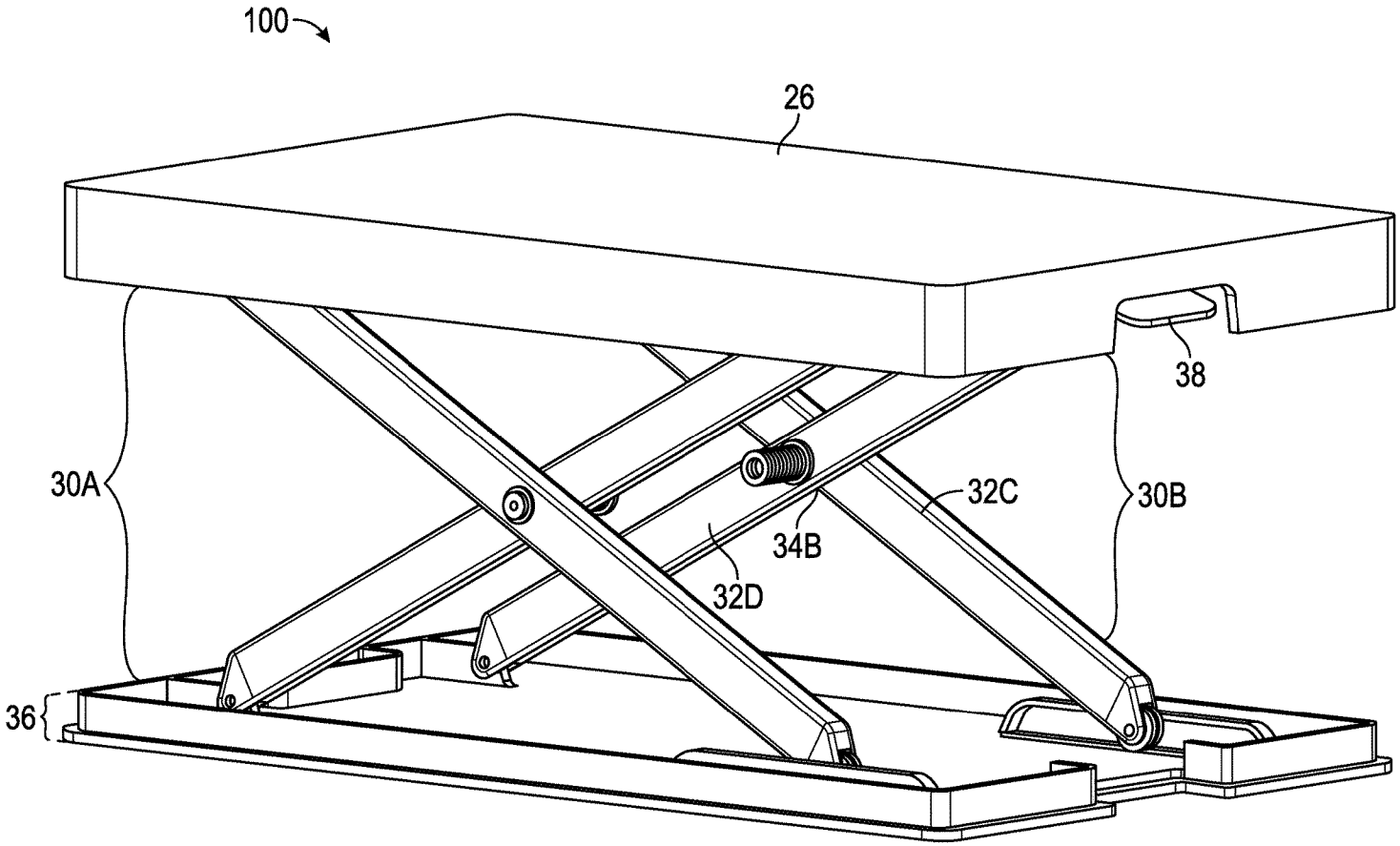
FIG. 4 illustrates a perspective view of a height adjustable device, in accordance with at least one example of this disclosure.

FIG. 4 illustrates a perspective view of a height adjustable device 100, in accordance with at least one example of this disclosure. The height adjustable device 100 can include at least a first scissor linkage assembly 30A as described above. The height adjustable device 100 can include a second scissor linkage assembly 30B. The worksurface 26 and the base 36 can be coupled to the first and second scissor linkage assemblies 30A, 30B. In the present application, a scissor leg assembly can also be referred to as a scissor lift mechanism or a scissoring linkage. The second scissor linkage assembly 30B can include a third arm member 32C and a fourth arm member 32D. The third and fourth arm members 32C, 32D can be coupled together near their middle areas by a rotable connection such as a second scissor joint 34B. The base 36 can be planar. The base can be rectangular, curved, or have a combination of curved and straight portions. The height adjustable device 100 can include a gas spring release handle 38 which will be described in more detail below.

Figure 5:
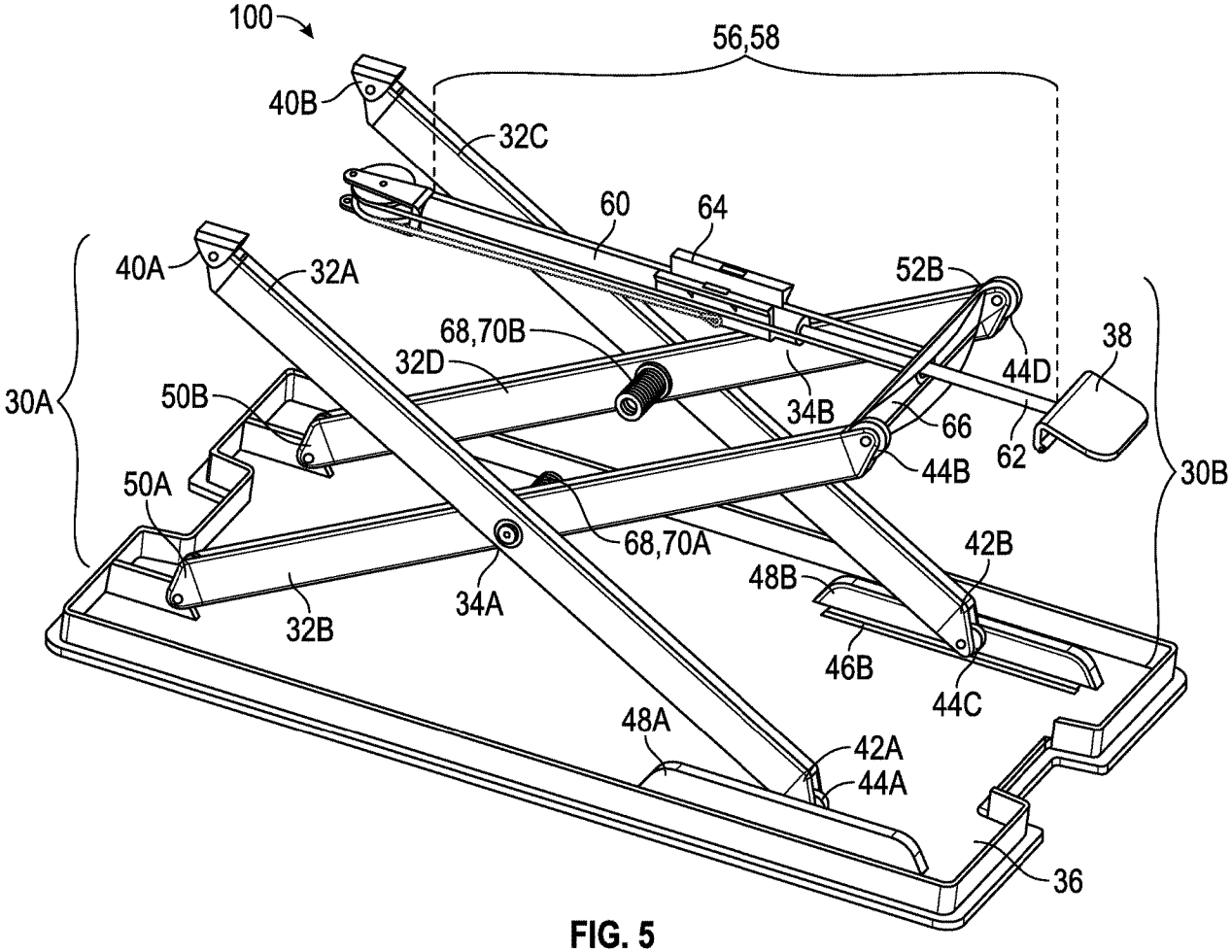
FIG. 5 illustrates a perspective view of a height adjustable device (with worksurface removed), in accordance with at least one example of this disclosure.

FIG. 5 illustrates a perspective view of a height adjustable device 100, in accordance with at least one example of this disclosure. The worksurface 26 (see FIG. 4) is removed to show other components. The first scissor linkage assembly 30A can include the first arm member 32A and the second arm member 32B. The first arm member 32A can be movably coupled to the worksurface 26 at a first upper joint 40A. The first upper joint 40A can be a pin joint, a hinge, or any type of joint where the first arm member 32A can be allowed to rotate relative to the worksurface 26. The first arm member 32A can be movably coupled to a base 36 at a first lower rolling/sliding joint 42A. The first lower rolling/sliding joint 42A can be any type of tracked, slotted, wheeled, or other joint connection that can allow the first arm member 32A to move horizontally and rotationally relative to the base 36. The first lower rolling/sliding joint 42A can include an element such as a first roller 44A that can roll/slide along the base 36. The first roller 44A can ride on the base 36, and can allow the second end of the first arm member 32A to move in a straight path parallel to the length of the base 36. A first track 46A (see FIG. 7) can be formed in to the base 36 to guide the lower rolling elements. A first guide member 48A can be located along a side of the first lower rolling/sliding joint 42A and can guide one or both of the first arm member 32A or the first roller 44A.

The second arm member 32B can be movably coupled to the worksurface 26 at a first lower joint 50A. The first lower joint 50A can be a pin joint, a hinge, or any type of joint where the second arm member 32B can be allowed to rotate relative to the base 36. The second arm member 32B can be movably coupled to the worksurface 26 at a first upper rolling/sliding joint 52A. The first upper rolling/sliding joint 52A can be any type of tracked, slotted, wheeled, or other joint connection that can allow the second arm member 32B to move horizontally and rotationally relative to the worksurface 26. The first upper rolling/sliding joint 52A can include an element, such as a second roller 44B that can roll/slide along the bottom surface 54 of the worksurface 26 (see FIG. 8). The second roller 44B can allow the second end of the second arm member 32B to move in a straight path parallel to the length of the worksurface 26.

The second scissor linkage assembly 30B can include the third arm member 32C and the fourth arm member 32D. The third arm member 32C can be movably coupled to the worksurface 26 at a second upper joint 40B. The second upper joint 40B can be a pin joint, a hinge, or any type of joint where the third arm member 32C can be allowed to rotate relative to the worksurface 26. The third arm member 32C can be movably coupled to the base 36 at a second lower rolling/sliding joint 42B. The second lower rolling/sliding joint 42B can be any type of tracked, slotted, wheeled, or other joint connection that can allow the third arm member 32C to move horizontally and rotationally relative to the base 36. The second lower rolling/sliding joint 42B can include an element such as a third roller 44C that can roll/slide along the base 36. The third roller 44C can ride on the base 36, and can allow the second end of the third arm member 32C to move in a straight path parallel to the length of the base 36. The second track 46B can be formed in to the base 36 to guide the lower rolling elements. A second guide member 48B can be located along a side of the second lower rolling/sliding joint 42B and can guide one or both of the third arm member 32C or the third roller 44C.

The fourth arm member 32D can be movably coupled to the worksurface 26 at a second lower joint 50B. The second lower joint 50B can be a pin joint, a hinge, or any type of joint where the fourth arm member 32D can be allowed to rotate relative to the base 36. The fourth arm member 32D can be movably coupled to the worksurface 26 at a second upper rolling/sliding joint 52B. The second upper rolling/sliding joint 52B can be any type of tracked, slotted, wheeled, or other joint connection that can allow the fourth arm member 32D to move horizontally and rotationally relative to the worksurface 26. The second upper rolling/sliding joint 52B can include an element such as a fourth roller 44D that can roll/slide along the bottom surface 54 of the worksurface 26. The fourth roller 44D can allow the second end of the fourth arm member 32D to move in a straight path parallel to the length of the worksurface 26. In some example configurations, any or all of the first, second, third, or fourth rollers 44A, 44B, 44C, 44D can be replaced by gliding elements, sliding pins, or slides.

A first energy storage member 56 can be located under the worksurface 26. The first energy storage member 56 can be a gas spring, one or more elastic members such as an extension spring or elastomeric strap, or a combination of any of the previously mentioned devices. In the present application the first energy storage member 56 can also be referred to as a gas spring 58. The gas spring 58 can include a gas spring cylinder 60 and a gas spring piston 62. The gas spring piston 62 can extend and retract from the gas spring cylinder 60. The gas spring 58 can be stabilized under a worksurface 26 by a gas spring cradle 64. The gas spring cradle 64 can be shaped to fit around all or a portion of the gas spring 58 and configured support the gas spring 58. The gas spring cradle 64 can be coupled to the worksurface 26 and the gas spring 58/gas spring cylinder 60 can slide within the gas spring cradle 64.

The second arm member 32B and the fourth arm member 32D can be coupled to a moving bracket 66 (can also be known as "bracket"). In an example, the second arm member 32B and the fourth arm member 32D can be rotatingly attached to the moving bracket 66. The moving bracket 66 can move horizontally relative to the worksurface 26. The gas spring piston 62 can engage a gas spring release handle 38, which can be configured to unlock the gas spring 58. A second energy storage member 68, shown as either or both of a first and second torsion spring 70A, 70B can be located at one or both of the first and second scissor joints 34A, 34B. The second energy storage member 68 can be a torsion spring, or any type of energy storage device that is configured to aid or counteract torque related forces at the first and/or second scissor joints 34A, 34B. The second energy storage member 68 can be used to assist a weight counterbalance. Because the first torsion spring 70A can contact the first and second arm members 32A, 32B and/or the second torsion spring 70B can contact the third and fourth arm members 32C, 32D at the first and second scissor joints 34A, 34B; when the height adjustable device is raised or lowered, the second energy storage member 68 can create a counterbalancing force.

It is fully contemplated by the present application that in another example, the first and second lower rolling/sliding joints 42A, 42B on the base 36 can be on the opposite end of the height adjustable device 100 as the first and second upper rolling/sliding joints 52A, 52B of the worksurface 26. Such a configuration would also apply to the first and second lower joints 50A, 50B and first and second upper joints 40A, 40B.

Figure 6:
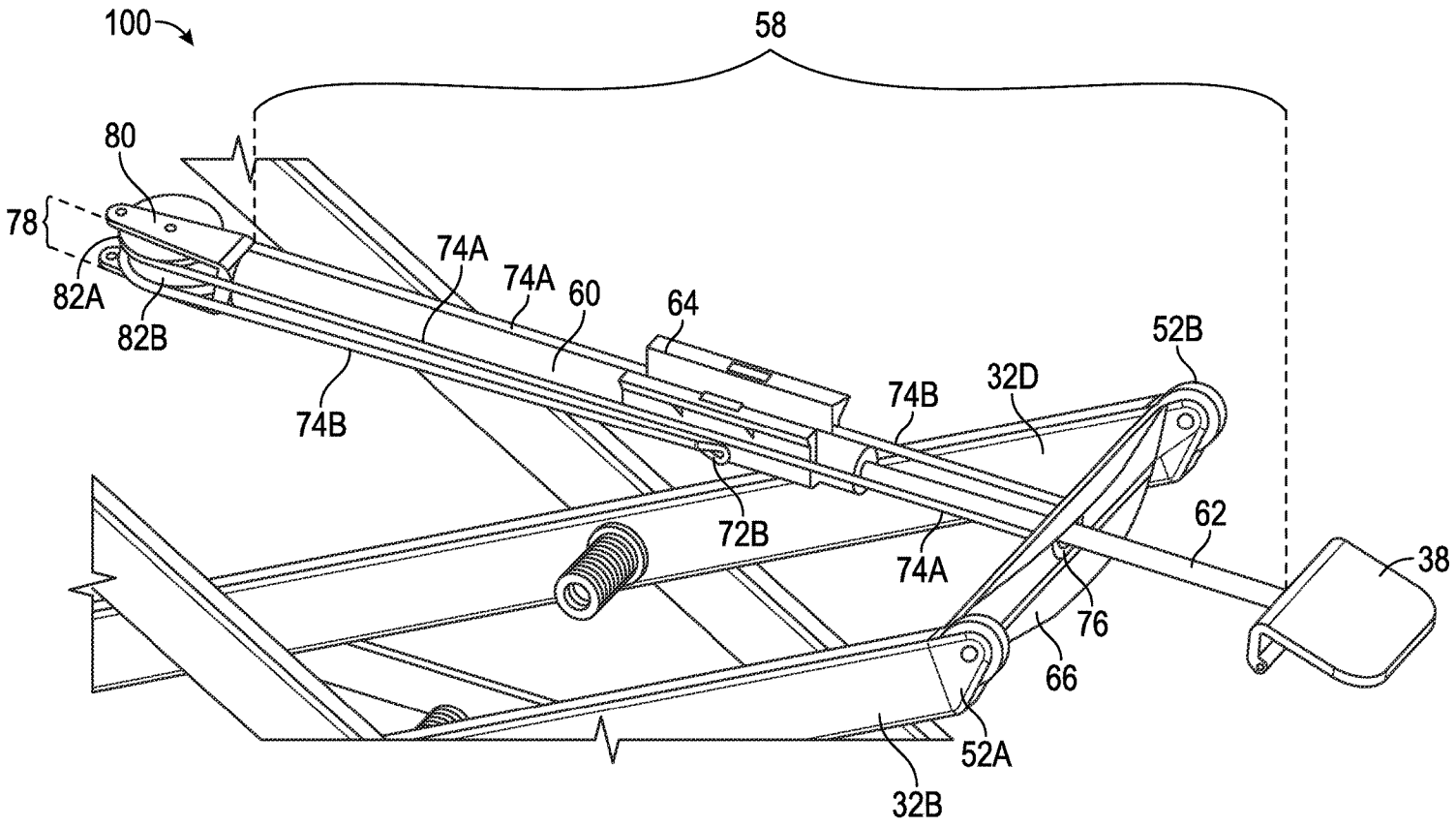
FIG. 6 illustrates a perspective view of a height adjustable device (with worksurface removed), in accordance with at least one example of this disclosure.
Figure 9:
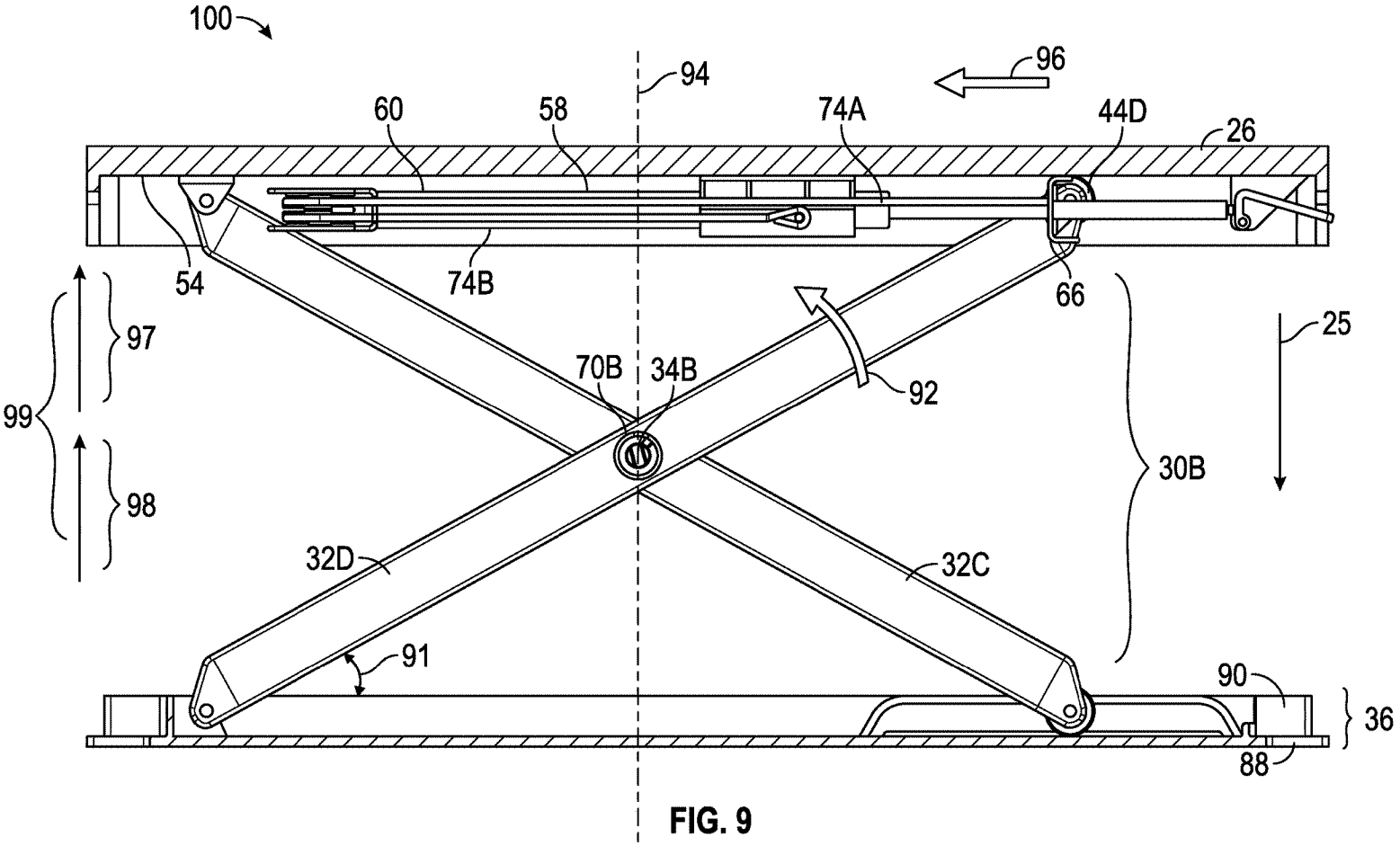
FIG. 9 illustrates a cross sectional side view of the height adjustable device of FIG. 8, in accordance with at least one example of this disclosure.

FIG. 6 illustrates a perspective view of a height adjustable device 100 (with worksurface removed), in accordance with at least one example of this disclosure. The gas spring cradle 64 can be coupled to the bottom surface 54 of the worksurface 26 (see (FIG. 9). A first attachment member 72A (see FIG. 11) and a second attachment member 72B can be coupled to or formed into the gas spring cradle 64 and can aid in attaching first and second tension members 74A, 74B to the gas spring cradle 64. The first and second attachment members 72A, 72B can be a hook, a protruding element, an aperture, a clamp, a crimp, or any other means of attaching a tension member to a bracket. In the present application, the first and second tension members 74A, 74B can include devices such as a rope, a cable, a strap, a chain, or a cord or a combination of the aforementioned elements. In another example, first and second tension members 74A, 74B can be coupled to the worksurface 26 (see FIG. 4). The gas spring piston 62 can be slidably engaged with the gas spring cylinder 60 on one end, and can be coupled to the worksurface 26 on the other end. A release pin (not shown) can be located at the tip of the gas spring piston 62 near attachment to the worksurface 26 (see FIG. 9). Normally, the gas spring 58 can be locked at all times.

When the height of the worksurface 26 needs to be adjusted, the gas spring release handle 38 can be squeezed; a tab located on the gas spring release handle 38 can press a release pin, and unlock the gas spring 58. With the gas spring 58 unlocked, a user can adjust the height of the worksurface 26. The moving bracket 66 can be rotatingly coupled with the second arm member 32B at the first upper rolling/sliding joint 52A, and can be rotatingly coupled with the fourth arm member 32D at the second upper rolling/sliding joint 52B. An aperture 76 can be defined near the middle of the moving bracket 66. The gas spring piston 62 can extend and slide through the aperture 76.

A pulley assembly 78 can be coupled to one end of the gas spring cylinder 60. The pulley assembly 78 can include a pulley holding bracket 80, a first pulley wheel 82A and a second pulley wheel 82B. The first pulley wheel 82A and the second pulley wheel 82B can be rotatingly engaged with the pulley holding bracket 80. The first pulley wheel 82A and the second pulley wheel 82B can be located on the same axis, but they can rotate independently of each other. A first tension member 74A can be coupled to the first attachment member 72A (see FIG. 12) on its first end, can be routed around the first pulley wheel 82A, and can be coupled to the moving bracket 66 on its second end. A second tension member 74B can be coupled to the second attachment member 72B on its first end, can be routed around the second pulley wheel 82B, and can be coupled to the moving bracket 66 on its second end.

Figure 7:
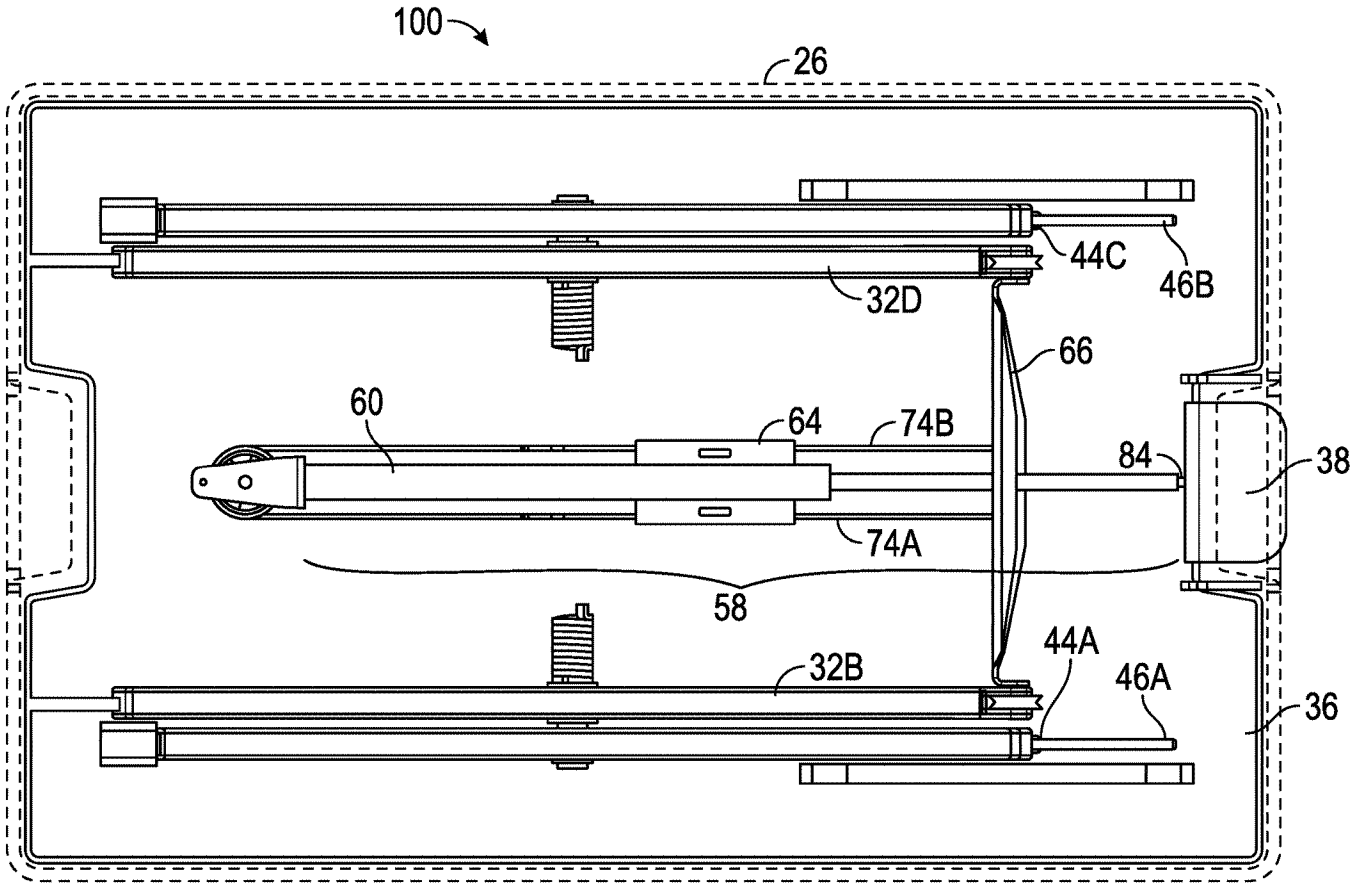
FIG. 7 illustrates a top view of a height adjustable device (with transparent worksurface), in accordance with at least one example of this disclosure.

FIG. 7 illustrates a top view of a height adjustable device 100, in accordance with at least one example of this disclosure. The worksurface 26 is shown as transparent to display other components under it. The first track 46A and a second track 46B can be formed into the base 36 to guide the lower rolling elements, such as the first roller 44A and the third roller 44C. The gas spring cylinder 60 can be allowed to slide within the gas spring cradle 64 as the worksurface 26 is raised or lowered. The gas spring 58 can bias the height adjustable device 100 towards the raised position 28 (see FIG. 2). The first tension member 74A and the second tension member 74B can be coupled to the moving bracket 66. The moving bracket 66 can be rotatingly coupled to the second arm member 32B and the fourth arm member 32D. A gas spring release pin 84 is shown at the end of the gas spring piston 62. The gas spring release pin 84 can unlock the gas spring 58 when actuated by the gas spring release handle 38.

Figure 8:
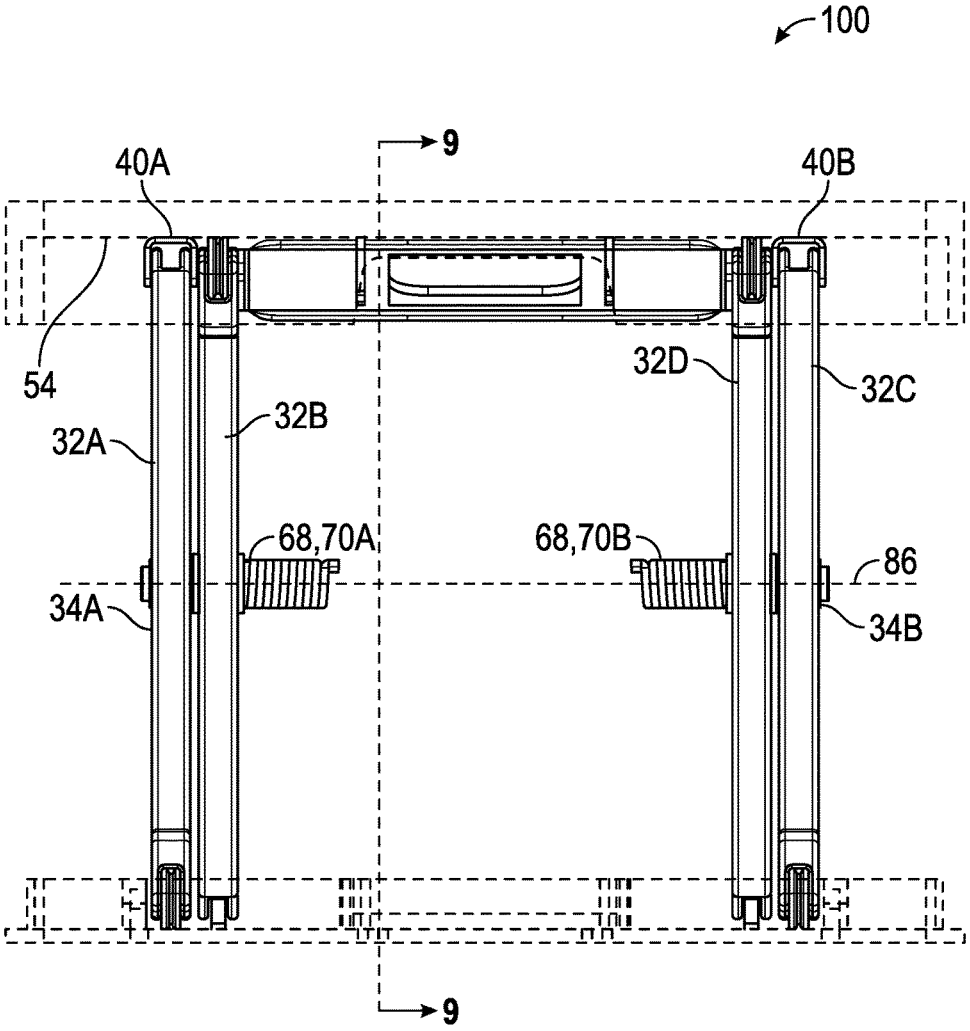
FIG. 8 illustrates a front view of a height adjustable device, accordance with at least one example of this disclosure.

FIG. 8 illustrates a front view of a height adjustable device 100, in accordance with at least one example of this disclosure. A second energy storage member 68 can be located at one or both of the first and second scissor joint 34A, 34B. As related above, the second energy storage member 68 can be a first and/or second torsion spring 70A, 70B. The main portion of the first torsion spring 70A can be located to the right of the second arm member 32B. The main portion of the second torsion spring 70B can be located to the left of the fourth arm member 32D. A torsion spring axis 86 can coincide with an axis of the first and second scissor joints 34A, 34B. A first leg of each torsion spring can be connected to one of the arms and a second leg of each torsion spring can be connected to the other arm. In an example, the torsion spring can be located on either side of the scissor joint, or in between the arms of the scissor joints (see FIGS. 11-12). The bottom surface 54 can provide attachment points for the first and second upper joints 40A, 40B of the first arm member 32A and the third arm member 32C.

FIG. 9 illustrates a cross sectional side view of the height adjustable device 100 of FIG. 8, in accordance with at least one example of this disclosure. As the worksurface 26 moves downwardly 25, a horizontally facing arm angle 91 (as well as other angles of the device—this angle is used for illustration purposes) can decrease, and as a result, tension on the second torsion spring 70B can increase. Tension of the second torsion spring 70B can cause a torque 92 to increase on the third and fourth arm members 32C, 32D and can bias the fourth roller 44D towards the center 94 (in a horizontal direction) of the second scissor joint 34B. As the worksurface 26 moves downwardly 25, the horizontally facing arm angle 91 can decrease, and the fourth roller 44D can move away from the center 94 of the second scissor joint 34B. As a result, the moving bracket 66 also can move away from the center 94 of the second scissor joint 34B. Since one end of the first and second tension members 74A, 74B are fixedly attached to the moving bracket 66, and the other end of the first and second tension members 74A, 74B is coupled to the gas spring cradle 64; the first and second tension members 74A, 74B can pull on the gas spring cylinder 60 and can cause the tension on the gas spring 58 to increase. The gas spring 58 can apply an increasing horizontal pull force 96 on to the moving bracket 66 and can bias the moving bracket 66 towards the center 94 of the second scissor joint 34B. As the horizontally facing arm angle 91 is decreased as the worksurface 26 is moved downwardly 25, a first vertical lift force 97 created by the gas spring 58 can also decrease. However, simultaneously the torque 92 and a second vertical lift force 98 applied onto the second scissor linkage assembly 30B by the second torsion spring 70B can increase. As a result, a total lift force 99 provided by the height adjustable device 100 can stay constant. Depending on an example configuration, (whether there is one or two torsion springs), some or all of the previously described actions will occur simultaneously on the first scissor linkage assembly 30A (see FIG. 8).

The base 36 can include a planar lower horizontal member 88 upon which a raised vertical member 90 can be integral or attached. Lower rollers can ride upon the planar lower horizontal member 88 and/or be guided by the first and second tracks 46A, 46B (see FIG. 7).

In additional examples, of the height adjustable device 100, the first and second energy storage members 56, 68, such as the gas spring 58, or the first and second torsion springs 70A, 70B can be calibrated for any weight that the height adjustable device 100 is designed to support. The energy storage members can be designed/calibrated to provide either a stronger or weaker biasing forces for raising or lowering the height adjustable device. The energy storage members can be provided with tensioning/spring force adjustments. The bottom surface 54 can provide attachment points for the gas spring cradle 64, and the gas spring 58.

Figure 10:
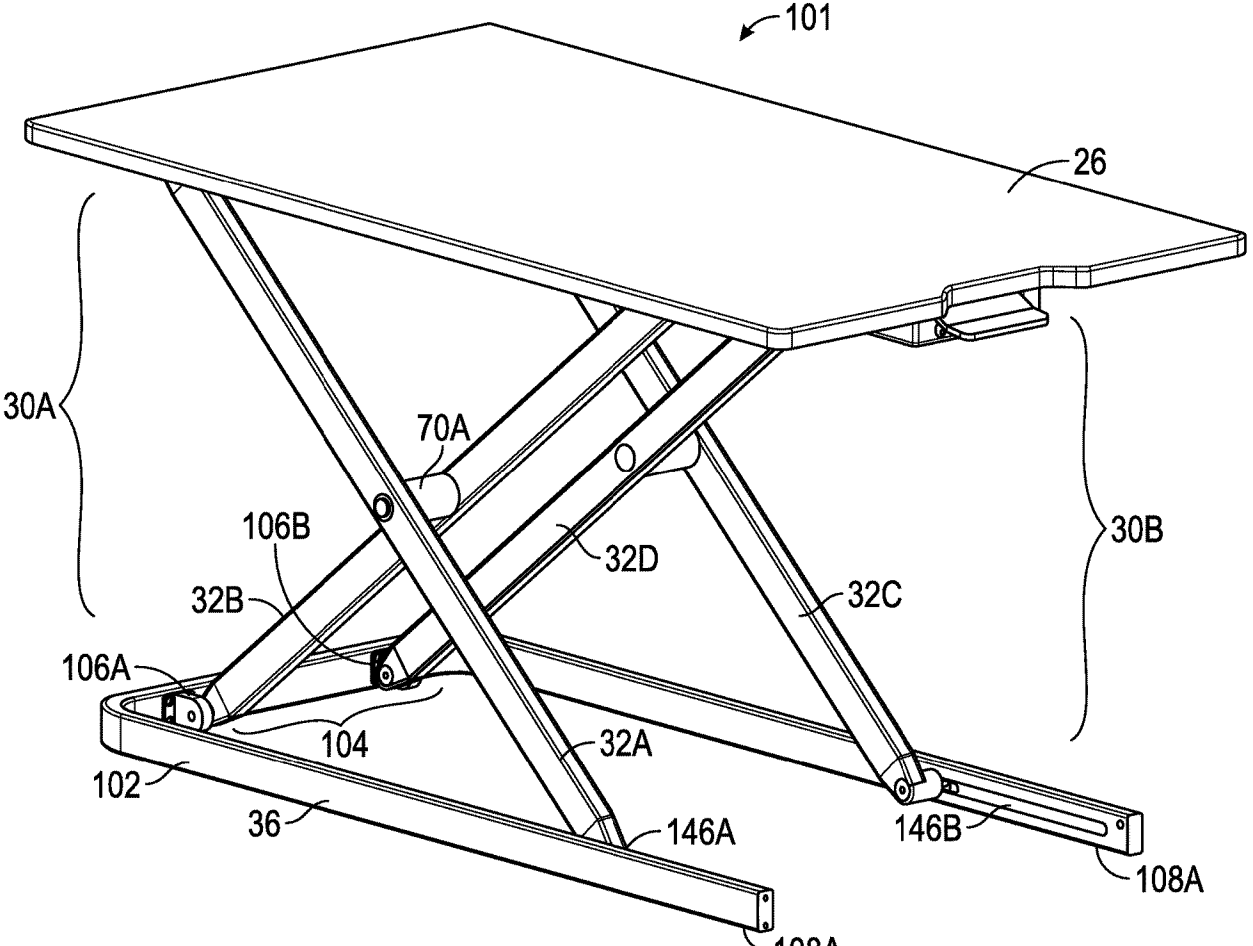
FIG. 10 illustrates a perspective view of a height adjustable, in accordance with at least one example of this disclosure.

FIG. 10 illustrates a perspective view of a height adjustable device 101, in accordance with at least one example of this disclosure. In an example, the base 36 can be configured in a U-shape 102 that can lay in a horizontal position on a floor or desktop surface. The middle portion 104 of the U-shape 102 can include a first rotable attachment point 106A for the second arm member 32B of the first scissor linkage assembly 30A and the base first end 108A of the U-shape 102 can provide a first track 146A for a sliding or rolling attachment for the first arm member 32A of the first scissor linkage assembly 30A.

The middle portion 104 of the U-shape 102 can include a second rotable attachment point 106B for the fourth arm member 32D of the second scissor linkage assembly 30B and the base second end 108B of the U-shape 102 can provide a second track 146B for a sliding or rolling attachment for the third arm member 32C of the second scissor linkage assembly 30B. The height adjustable device 101 can include a gas spring (see FIG. 12). A first and second torsion spring 70A, 70B can be used to assist weight counterbalance for raising, lowering, or supporting the worksurface 26.

Figure 11:
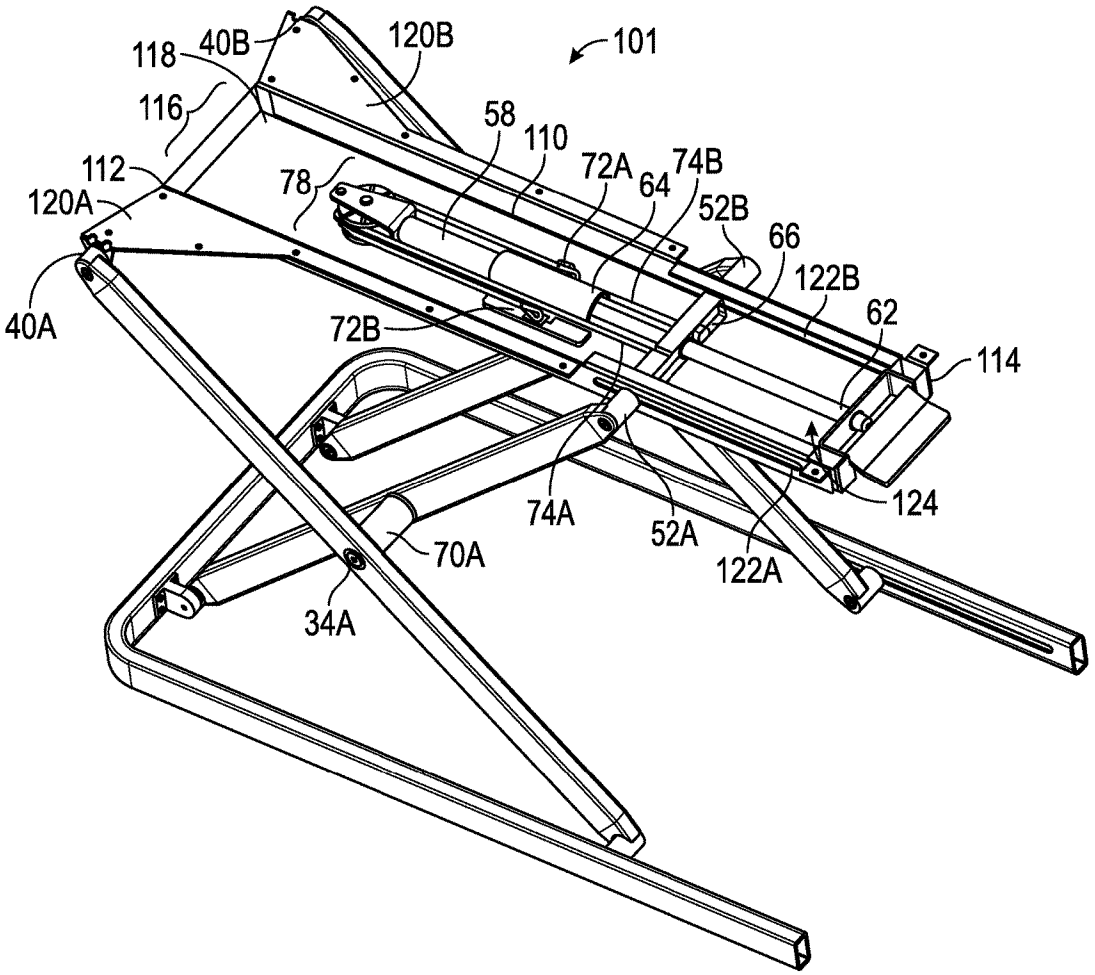
FIG. 11 illustrates a perspective view of the height adjustable device of FIG. 10, in accordance with at least one example of this disclosure.

FIG. 11 illustrates a perspective view of the height adjustable device 101 of FIG. 10, in accordance with at least one example of this disclosure. In FIG. 11, the worksurface 26 is removed to show the other components underneath. An enclosure bracket 110 can be coupled to the bottom surface 54 of the worksurface 26 (see FIG. 8). The enclosure bracket 110 can extend from a bracket first end 112 to a bracket second end 114. A channel portion 116 can provide a depth 118 (see also FIG. 14) that can receive the gas spring 58, the pulley assembly 78, and the gas spring cradle 64. At the bracket first end 112, the enclosure bracket 110 can include a first extension member 120A and a second extension member 120B that can provide attachment points for the first upper joint 40A and the second upper joint 40B. The enclosure bracket 110 can include a first and second slot 122A, 122B for the first and second upper rolling/sliding joints 52A, 52B. The first and second slots 122A, 122B can be configured as a slot, a track, a guide or similar configuration that can guide the horizontal movement of the first and second upper rolling/sliding joints 52A, 52B and/or the moving bracket 66.

The first torsion spring 70A is illustrated located at the first scissor joint 34A. Torsion springs can be located in each scissor joint. The working principles of this example can be the same as the example explained above. The gas spring piston 62 is shown in an extended position 124. In the extended position 124, the segment of the first and second tension members 74A, 74B from the first and second attachment members 72A, 72B to the pulley assembly 78 is long, when compared the same segment of the first and second tension members 74A, 74B from the first and second attachment members 72A, 72B to the pulley assembly 78 in a compressed position 126 shown in FIG. 12. Returning to FIG. 11, in the extended position 124, the pulley assembly 78 has extended away from the gas spring cradle 64. Because the gas spring 58 is connected by the first and second tension members 74A, 74B to the moving bracket 66 and allowed to slide in the gas spring cradle 64, the amount of gas spring length change can be different than the horizontal length that the moving bracket 66 moves from the extended position 124 to the compressed position 126. In an example, the gas spring length change can be double the horizontal length that the moving bracket 66 moves.

Figure 12:
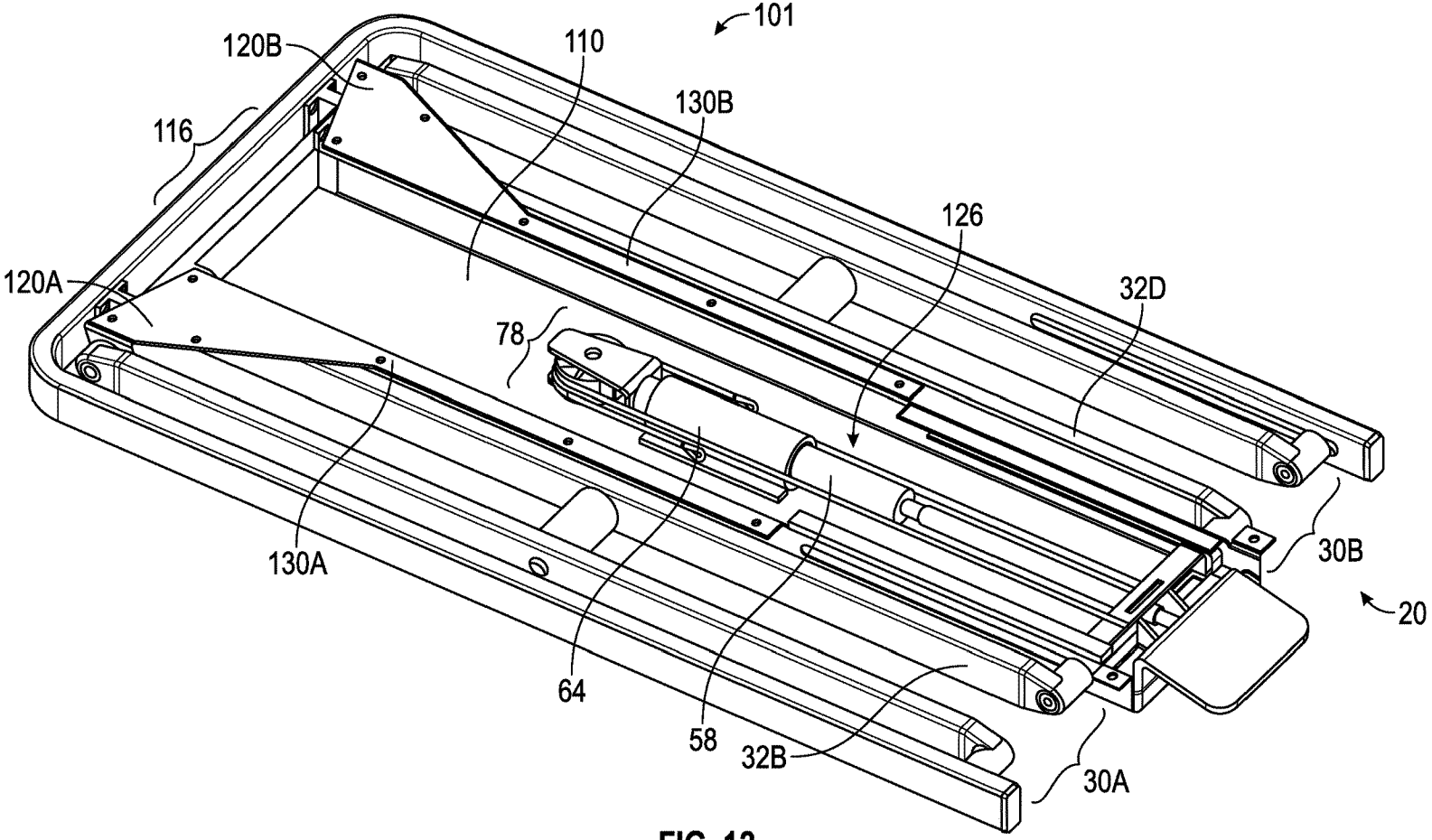
FIG. 12 illustrates a perspective view of a height adjustable device in a lowered position (worksurface is removed), in accordance with at least one example of this disclosure.

FIG. 12 illustrates a perspective view of a height adjustable device 101 in a lowered position 20 (worksurface is removed), in accordance with at least one example of this disclosure. The height adjustable device 101 is shown in a lowered position 20 with the first and second scissor linkage assemblies 30A, 30B folded. The gas spring 58 is shown in a compressed position 126. The pulley assembly 78 has moved closer to the gas spring cradle 64 as compared to the extended position 124 shown in FIG. 11. Returning to FIG. 12, the channel portion 116 can be narrow enough to nest between the second arm member 32B and fourth arm member 32D. The first extension member 120A and the second extension member 120B can rest atop the first and second scissor linkage assemblies 30A, 30B (while attached to a bottom surface 54 of the worksurface 26, see FIG. 8). The enclosure bracket 110 can include first and second side flanges 130A, 130B for additional attachment points to the worksurface 26.

Figure 13:
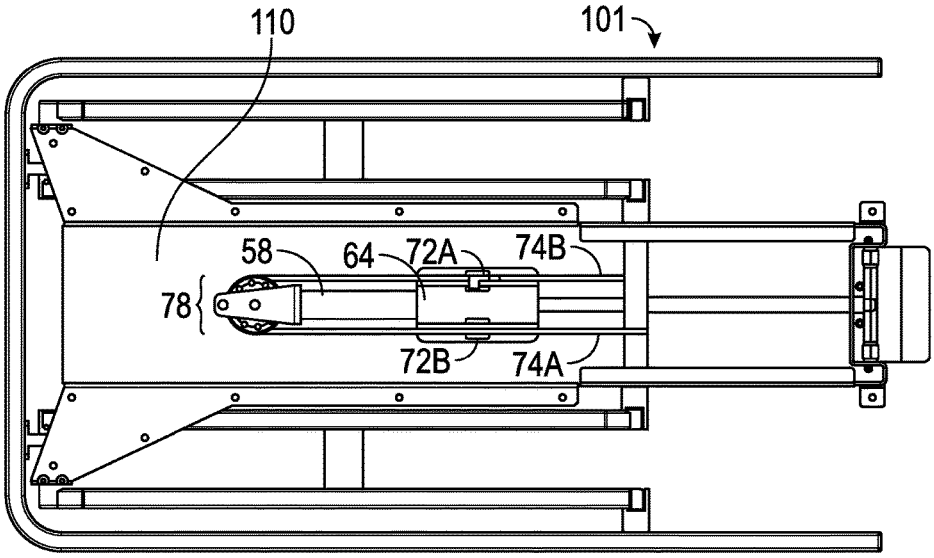
FIG. 13 illustrates a top view of a height adjustable device (worksurface is removed), in accordance with at least one example of this disclosure.

FIG. 13 illustrates a top view of a height adjustable device 101 (worksurface is removed), in accordance with at least one example of this disclosure. The first and second tension members 74A, 74B can be connected at one end to the moving bracket 66, extend around the pulley assembly 78 and then connected at the other end to the first and second attachment members 72A, 72B on the gas spring cradle 64. The gas spring 58 can be movable within the gas spring cradle 64. The gas spring cradle 64 can be coupled to the enclosure bracket 110.

Figure 14:
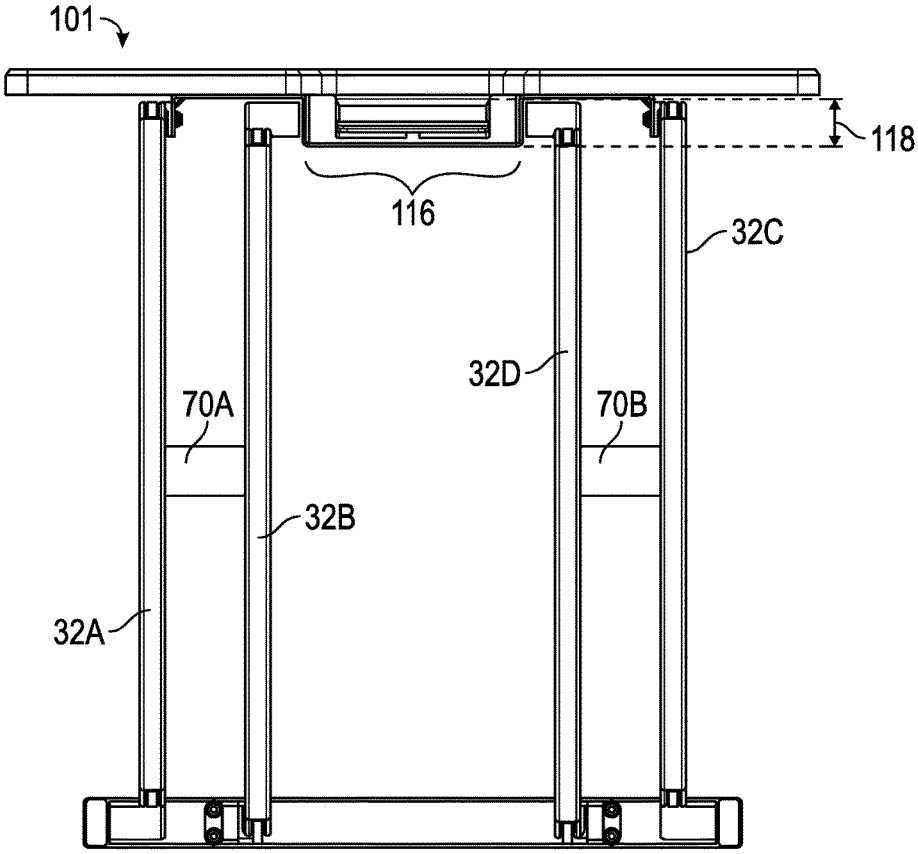
FIG. 14 illustrates a front view of a height adjustable device, in accordance with at least one example of this disclosure.

FIG. 14 illustrates a front view of a height adjustable device 101, in accordance with at least one example of this disclosure. In an example, the first torsion spring 70A can be mounted between the first and second arm members 32A, 32B. In an example, the second torsion spring 70B can be mounted between the third and fourth arm member 32C, 32D. The depth 118 of the channel portion 116 is shown.

Figure 15:
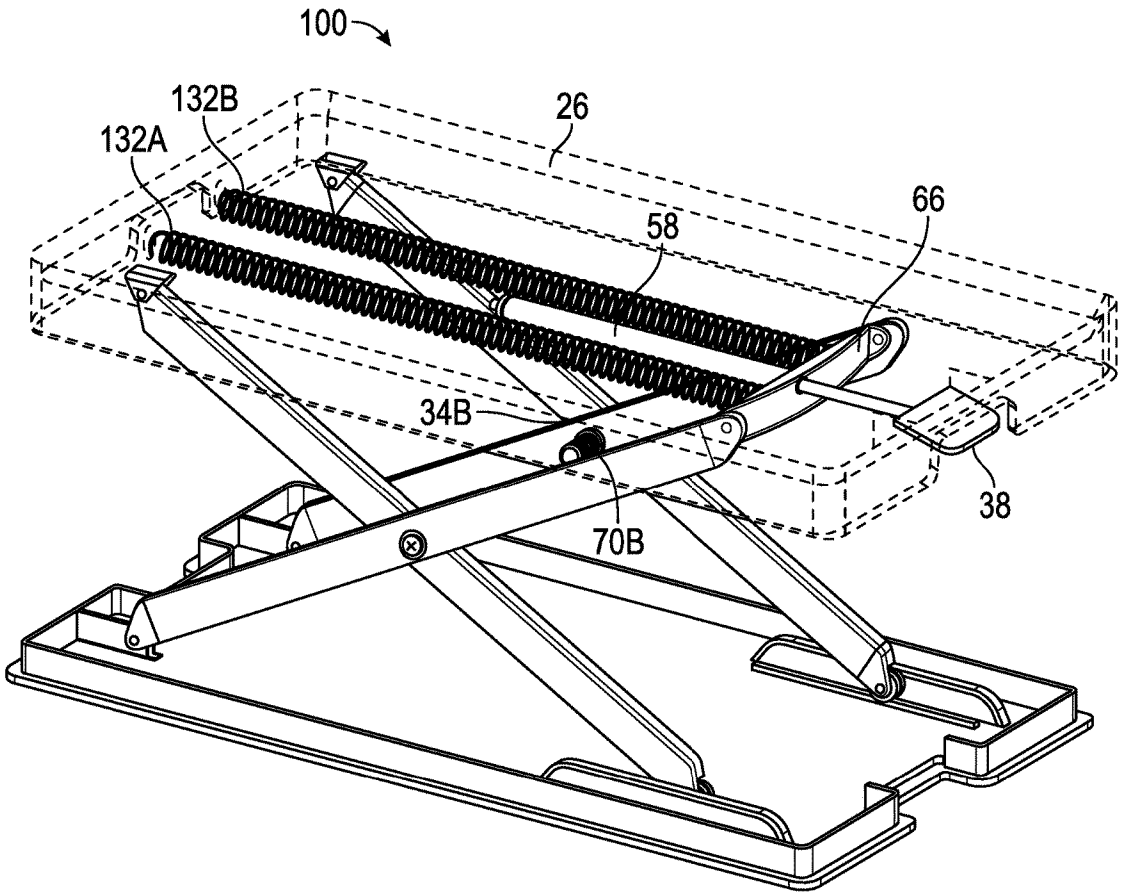
FIG. 15 illustrates a perspective view of a height adjustable device 100, in accordance with at least one example of this disclosure.

FIG. 15 illustrates a perspective view of a height adjustable device 100, in accordance with at least one example of this disclosure. A first and second extension spring 132A, 132B can be mounted between the moving bracket 66 and the worksurface 26. In another example the first and second extension spring 132A, 132B can be mounted between the moving bracket 66 and the enclosure bracket 110 (see FIG. 12). In some configurations, a lift force can be provided by means of at least one extension spring. One or more torsion springs can be used to assist the weight counterbalance. A second torsion spring 70B is shown located at the second scissor joint 34B. Torsion springs can also be used to supplement the lift force. A gas spring 58 configured to lock and unlock can also be included to be able to lock/unlock and raise/lower the height adjustable device 100. A gas spring release handle 38 can be pressed to unlock the gas spring 58.

Figure 16:
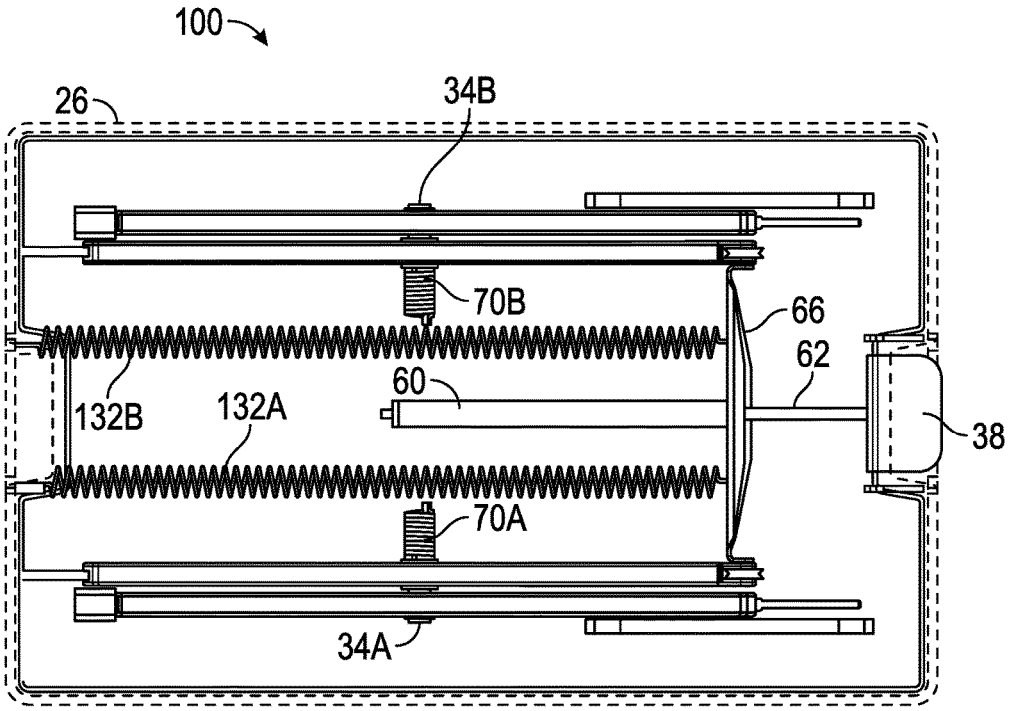
FIG. 16 illustrates a top view of a height adjustable device (worksurface is removed), in accordance with at least one example of this disclosure.

FIG. 16 illustrates a top view of a height adjustable device 100, in accordance with at least one example of this disclosure. The first and second extension spring 132A, 132B can be located under the worksurface 26 (see FIG. 15). One or more extension springs can be used. One end of the first and second extension springs 132A, 132B can be fixedly attached to the worksurface 26. The other end of the first and second extension springs 132A, 132B can be fixedly attached to the moving bracket 66. The extension springs can bias the moving bracket 66 towards the center of the first and second scissor joints 34A, 34B (in a horizontal direction).

The moving bracket 66 can move parallel to the worksurface 26 as explained in the previous sections. As the worksurface 26 is moved downwardly to a lower position, the moving bracket 66 moves away from the center of the first and second scissor joints 34A, 34B, and can increase the tension on the first and second extension spring 132A, 132B, which can be elongated. In addition, first and second torsion springs 70A, 70B can be located at the first and second scissor joints 34A, 34B. A lift force provided by the extension spring and torsion spring complement each other as explained in previous sections. A resulting lift force can be constant.

A gas spring cylinder 60 can be fixedly attached to the moving bracket 66. A gas spring piston 62 can be slidably engaged with the gas spring cylinder 60 and coupled to the worksurface 26. A tip of the gas spring piston 62 can be in contact to a gas spring release handle 38. A gas spring release pin 84 (see FIG. 7) can be located at the tip of the gas spring piston 62. Normally, the gas spring 58 is locked at all times. When the height of the worksurface needs to be adjusted, the gas spring release handle 38 can be actuated; a tab located on the gas spring release handle 38 presses on to the gas spring release pin 84, and can unlock the gas spring 58. The user can proceed to adjust the height level of the height adjustable device 100.

Figure 17:
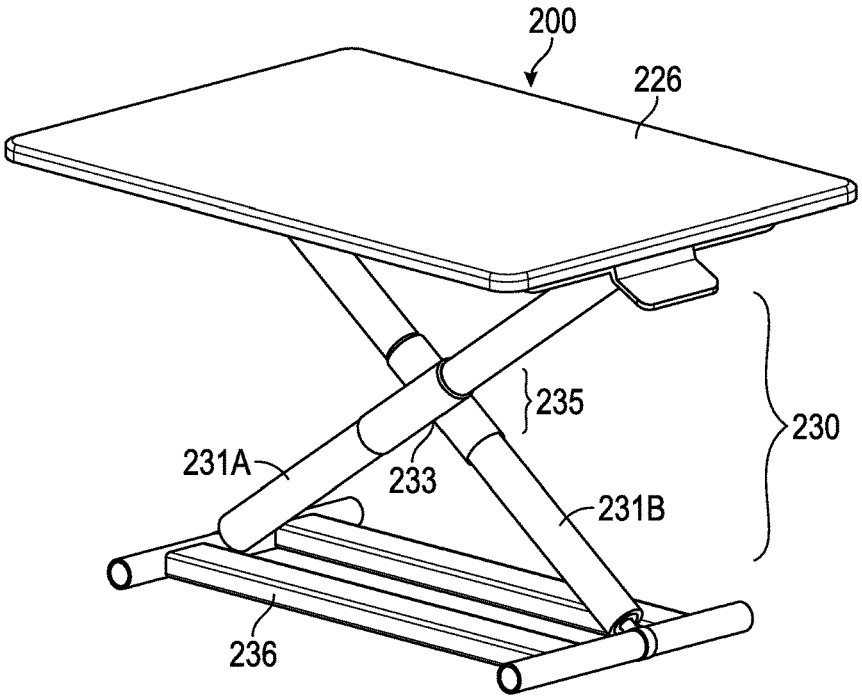
FIG. 17 illustrates a perspective view of a height adjustable device 200, in accordance with at least one example of this disclosure.

FIG. 17 illustrates a perspective view of a height adjustable device 200, in accordance with at least one example of this disclosure. The height adjustable device 200 can include a base 236, a worksurface 226, and a scissor linkage assembly 230. The scissor linkage assembly 230 can include a first gas spring assembly 231A and a second gas spring assembly 231B that can be connected in a scissor joint 233 at a collar assembly 235. The first and second gas spring assemblies 231A, 231B can each include a gas spring and an outer cover.

Figure 18:
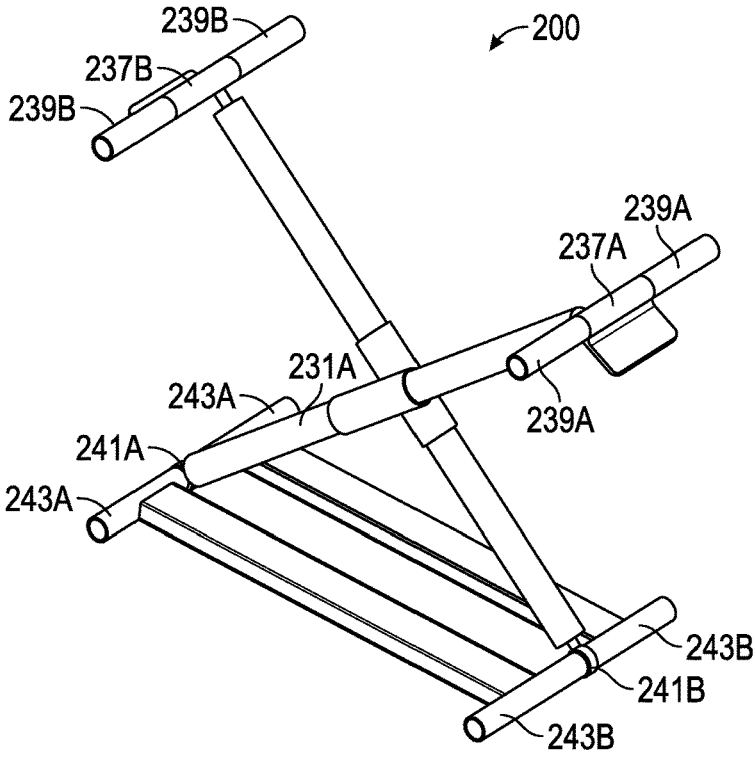
FIG. 18 illustrates a perspective view of a height adjustable device 200, in accordance with at least one example of this disclosure.

FIG. 18 illustrates a perspective view of a height adjustable device 200, in accordance with at least one example of this disclosure. The worksurface 226 is not shown for clarity. The first gas spring assembly 231A can include a first upper rotating member 237A and a first upper fixed member 239A (may be in two portions). The worksurface 26 (see FIG. 18) can be coupled to the first upper fixed member 239A. The first upper rotating member 237A can be located between two portions of the first upper fixed member 239A and can rotate relative to the first upper fixed member 239A as the height adjustable device 100 is raised and lowered. The second gas spring assembly 231B can include second upper rotating member 237B and a second upper fixed member 239B (may be in two portions). The worksurface 26 can be coupled to the second upper fixed member 239B. The second upper rotating member 237B can be located between two portions of the second upper fixed member 239B and can rotate relative to the second upper fixed member 239B as the height adjustable device 200 is raised and lowered.

The first gas spring assembly 231A can include a first lower rotating member 241A and a first lower fixed member 243A (may be in two portions). The base 36 can be coupled to the first lower fixed member 243A. The first lower rotating member 241A can be located between two portions of the first lower fixed member 243A and can rotate relative to the first lower fixed member 243A as the height adjustable device is raised and lowered. The second gas spring assembly 231B can include second lower rotating member 241B and a second lower fixed member 243B (may be in two portions). The base 236 can be coupled to the second lower fixed member 243B. The second lower rotating member 241B can be located between two portions of the second lower fixed member 243B and can rotate relative to the second lower fixed member 243B as the height adjustable device 200 is raised and lowered.

Figure 19:
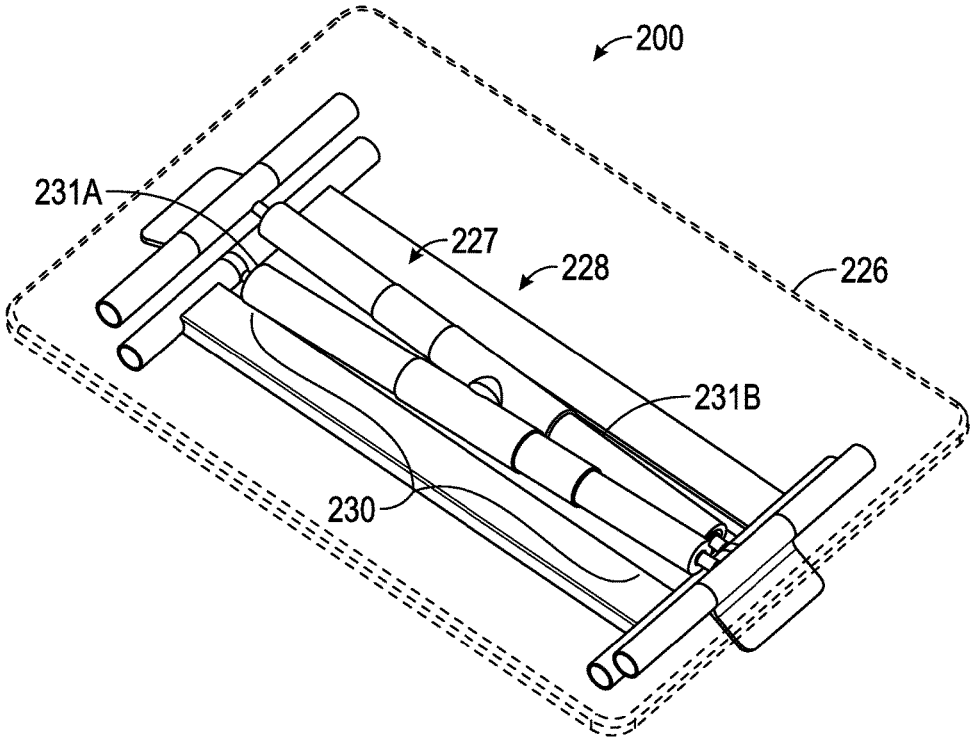
FIG. 19 illustrates a perspective view of a height adjustable device in a folded configuration, in accordance with at least one example of this disclosure.

FIG. 19 illustrates a perspective view of a height adjustable device 200 in a folded configuration 228 in accordance with at least one example of this disclosure. The height adjustable device 200 can include a scissor linkage assembly 230. The worksurface 226 is made transparent to show the components under it. In the folded configuration 228, the first and second gas spring assemblies 231A, 231B are shown in a compressed position 227.

Figure 20:
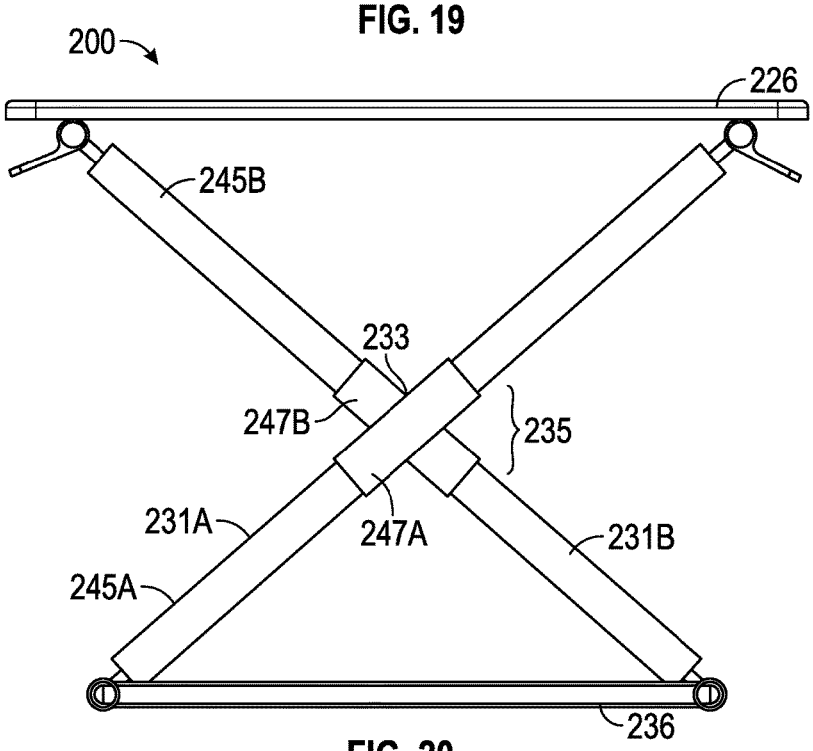
FIG. 20 illustrates a side view of a height adjustable device, in accordance with at least one example of this disclosure.

FIG. 20 illustrates a side view of a height adjustable device 200, in accordance with at least one example of this disclosure. The height adjustable device 200 can include a worksurface 226 and a base 236. The first gas spring assembly 231A can include an outer covering, such as a first telescoping cover 245A. The second gas spring assembly 231B can include an outer covering, such as a second telescoping cover 245B. The first and second telescoping covers 245A, 245B can hide or protect gas springs (see FIG. 21). The height adjustable device 200 can include a collar assembly 235 having a first collar portion 247A that can be slidably engaged with the first gas spring assembly 231A and a second collar portion 247B that can be slidably engaged with the second gas spring assembly 231B. The first and second collar portions 247A, 247B can be rotatably coupled with each other at the scissor joint 233 and can include a torsion spring connected to the first and second collar portions 247A, 247B.

Figure 21:
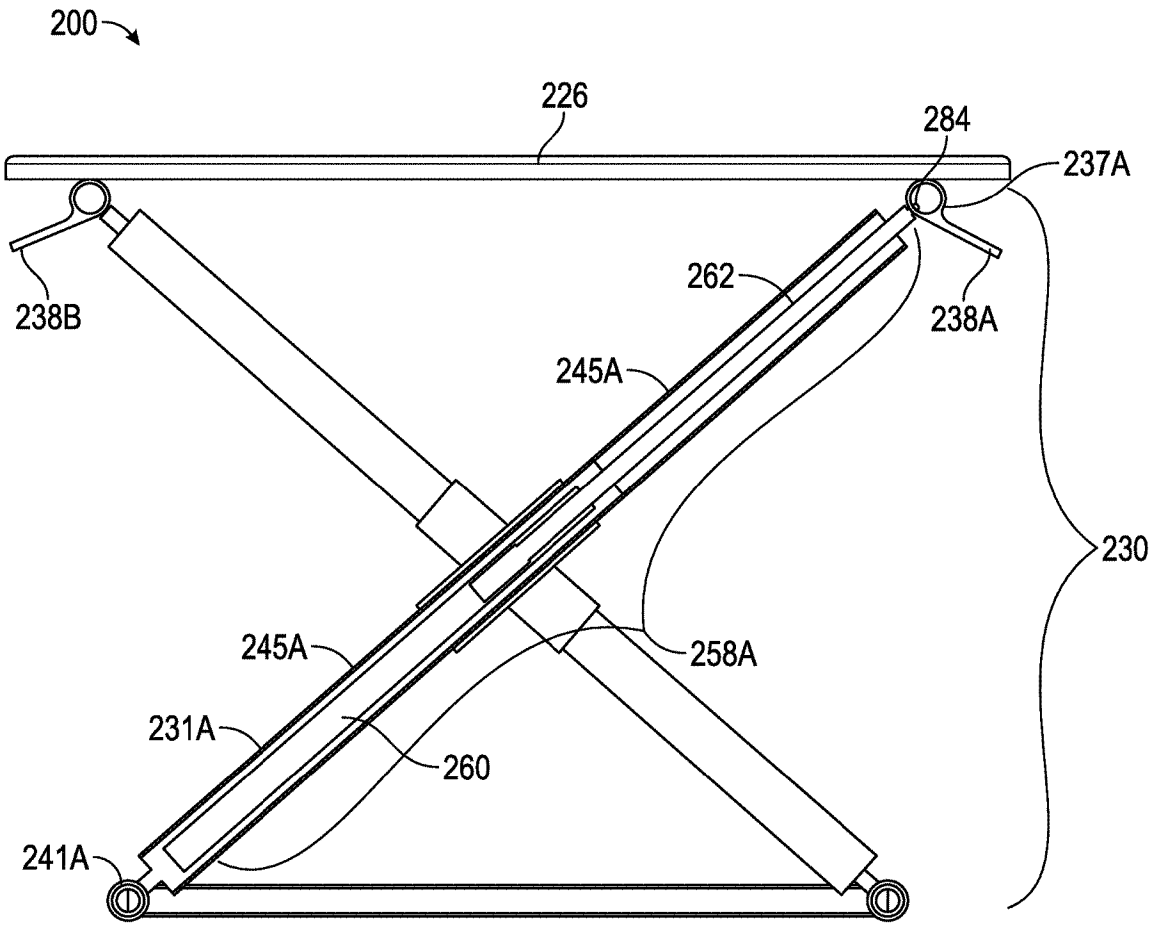
FIG. 21 illustrates a side view of a height adjustable device, in accordance with at least one example of this disclosure.

FIG. 21 illustrates a side view of a height adjustable device 200 including a scissor linkage assembly 230, in accordance with at least one example of this disclosure. The first gas spring assembly 231A is shown in cross section. The first telescoping cover 245A can include a first gas spring 258 having first gas spring cylinder 260 and a first gas spring piston 262. The gas spring piston 262 can be slidably engaged with the gas spring cylinder 260. A lower end of the gas spring cylinder 260 can be fixedly attached to the first lower rotating member 241A. An upper end of the gas spring piston 262 can be fixedly attached to the first upper rotating member 237A.

A release pin 284 can be located on the upper end of the gas spring piston 262 right near the first gas spring release handle 238A, such as underneath the handle. The first and second gas springs 258A, (258B under cover) can normally be locked, and therefore, any height adjustment can be disabled. When the first and second gas spring release handles 238A, 238B are actuated or squeezed, a tab located on each handle can press the release pins and can unlock the gas springs. A user can adjust the height of the worksurface 226 by pushing it down or allowing it to rise. The second gas spring assembly 231B can include similar internal elements. Any of the examples provided herein can be configured with varied gas spring, torsion spring or extension spring strengths to support whatever load is required.

A method of adjusting a desk or worksurface is provided. By providing a height adjustable device with a torsion spring at a scissor joint and a first energy storage member located under a worksurface, a constant vertical lifting force can be achieved and a height adjustable device can hold a weight placed on it through the whole vertical travel range. The torsion spring or second energy storage member can be configured to act upon angular motion at the scissor joint, while the first energy storage member, such as a gas spring or an extension spring is configured to act upon a horizontal motion between the moving bracket and the worksurface.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

The above description is intended to be illustrative, and not restrictive. For example, the above-described examples (or one or more aspects thereof) may be used in combination with each other. Other embodiments can be used, such as by one of ordinary skill in the art upon reviewing the above description. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A height adjustable device comprising:

a base;

a first scissor linkage assembly coupled to the base and having a first scissor joint;

a second scissor linkage assembly coupled to the base and having a second scissor joint;

a worksurface coupled to the first and second scissor linkages;

a bracket movably coupled to the first scissor linkage and the second scissor linkage and movable relative to the worksurface; and a first energy storage member coupled to the worksurface and connected by at least one flexible tension member to the bracket, wherein the first energy storage member is configured to bias the bracket in a horizontal direction.

2. The height adjustable device of claim 1, further comprising:

a second energy storage member located at one of the first and second scissor joints, the second energy storage member configured to bias the worksurface upwardly; and wherein the first energy storage member and the second energy storage member are configured to provide the height adjustable device with a constant lifting force throughout a vertical height adjustment range.

3. The height adjustable device of claim 2, wherein the second energy storage member is a torsion spring.

4. The height adjustable device of claim 2, wherein the first energy storage member is a gas spring coupled to the worksurface, extending through an aperture in the bracket, and connected by the at least one tension member to the bracket, wherein the gas spring is configured to bias the bracket in a horizontal direction;

wherein the second energy storage member is a torsion spring located at one of the first and second scissor joints, the torsion spring configured to bias the worksurface upwardly; and wherein the gas spring and the torsion spring are configured to provide the height adjustable device with a constant lifting force throughout a vertical height adjustment range.

5. The height adjustable device of claim 1, further comprising:

a second energy storage member located at one of the first and second scissor joints, the second energy storage member configured to bias the worksurface upwardly.

6. The height adjustable device of claim 5, wherein the first energy storage member and the second energy storage member are configured to provide the height adjustable device with a constant lifting force throughout a vertical height adjustment range.

7. The height adjustable device of claim 1, wherein the first energy storage member is a gas spring.

8. The height adjustable device of claim 7, further comprising a cradle member coupled to the worksurface and slidably coupled to the gas spring.

9. The height adjustable device of claim 7, wherein the gas spring includes a movable piston configured to extend through an aperture in the bracket.

10. The height adjustable device of claim 7, further comprising a pulley assembly coupled to the gas spring.

11. The height adjustable device of claim 10, wherein the at least one flexible tension member includes a first tension member, and the pulley assembly includes a first pulley wheel rotably engaging the first tension member, the first tension member connecting the bracket and the cradle member.

12. The height adjustable device of claim 11, wherein the at least one flexible tension member includes a second tension member, and the pulley assembly includes a second pulley wheel rotably engaging the second tension member, the second tension member connecting the bracket and the cradle member.

13. The height adjustable device of claim 1, wherein the first scissor linkage assembly includes:

a first arm member movably coupled to the base; and a second arm member coupled to the first arm member at the first scissor joint, the second arm member rotably coupled to the base; and wherein the second scissor linkage assembly includes:

a third arm member movably coupled to the base; and a fourth arm member coupled to the third arm member at a second scissor joint, the fourth arm member rotably coupled to the base.

14. The height adjustable device of claim 1, wherein the base is configured in a U-shape.

15. The height adjustable device of claim 1, further comprising an enclosure bracket attached to a bottom surface of the worksurface, wherein first and second scissor linkage assemblies are rotatably attached to the enclosure bracket.

16. The height adjustable device of claim 1, wherein the first scissor linkage assembly includes a first roller configured to roll on the base and the first scissor linkage assembly includes a second roller configured to roll on the base.

* * * * *